US005792263A

United States Patent [19]

Koyama et al.

[11] Patent Number: 5,792,263

[45] Date of Patent: Aug. 11, 1998

[54] TAPE CARTRIDGE FOR COATING FILM TRANSFER TOOL AND COATING FILM TRANSFER TOOL CONTAINING THE CARTRIDGE

[75] Inventors: Kouhei Koyama; Shigeru Tamai, both of Osaka; Masatoshi Shintani, Sanda, all of Japan

[73] Assignee: Seed Rubber Company, Ltd., Osaka, Japan

[21] Appl. No.: 571,227

[22] Filed: Dec. 12, 1995

[30] Foreign Application Priority Data

Nov. 1, 1995 [JP] Japan ..... 7-310038

[51] Int. Cl.[6] ..... B05C 1/00

[52] U.S. Cl. ..... 118/257; 118/200; 156/577; 156/579

[58] Field of Search ..... 118/200, 257; 400/695, 696, 700; 156/577, 579

[56] References Cited

U.S. PATENT DOCUMENTS

| | | | |
|---|---|---|---|
| 3,889,310 | 6/1975 | Barouh et al. . | |
| 4,426,169 | 1/1984 | Hartmann . | |
| 4,521,471 | 6/1985 | Merrill . | |
| 4,547,088 | 10/1985 | Shattuck . | |
| 4,671,687 | 6/1987 | Tamai . | |
| 4,718,971 | 1/1988 | Summers | 156/579 |
| 4,826,562 | 5/1989 | Ehlis | 156/477 |
| 5,125,589 | 6/1992 | Manusch . | |
| 5,310,445 | 5/1994 | Tucker | 156/577 |
| 5,346,580 | 9/1994 | Elges et al. | 156/577 |
| 5,379,477 | 1/1995 | Tamai et al. | 118/257 |
| 5,430,904 | 7/1995 | Ono et al. | 118/257 |
| 5,490,898 | 2/1996 | Koyama | 118/257 |
| 5,499,877 | 3/1996 | Sakanishi et al. . | |
| 5,507,908 | 4/1996 | Fukushima et al. | 156/577 |

FOREIGN PATENT DOCUMENTS 672063 7/1979 U.S.S.R. .

*Primary Examiner*—Laura Edwards

[57] ABSTRACT

A tape cartridge detachably attached to a refill type coating film transfer tool that allows replacement of coating film transfer tapes. The cartridge is formed in a compact size and simple structure using fewer components than prior devices. The cartridge is made up of a rotatable pay-out reel with a coating film transfer tape wound thereabout, a rotatable take-up winding reel for collecting a used tape, and a head therebetween for pressing the tape onto a transfer area. All of these elements are provided on a support base, which is in a form of a thin flat plate. The structure is small and simple. The tape is paid out from pay-out reel, passed through the leading end pressing part of the head, and then taken up on the take-up winding reel. When replacing the tape cartridges, the support base with both reels and the head as mounted on the pay-out rotation part, the take-up winding rotation part, and a cylindrical half in the leading end of the case main body.

25 Claims, 16 Drawing Sheets

FIG. 6(a)
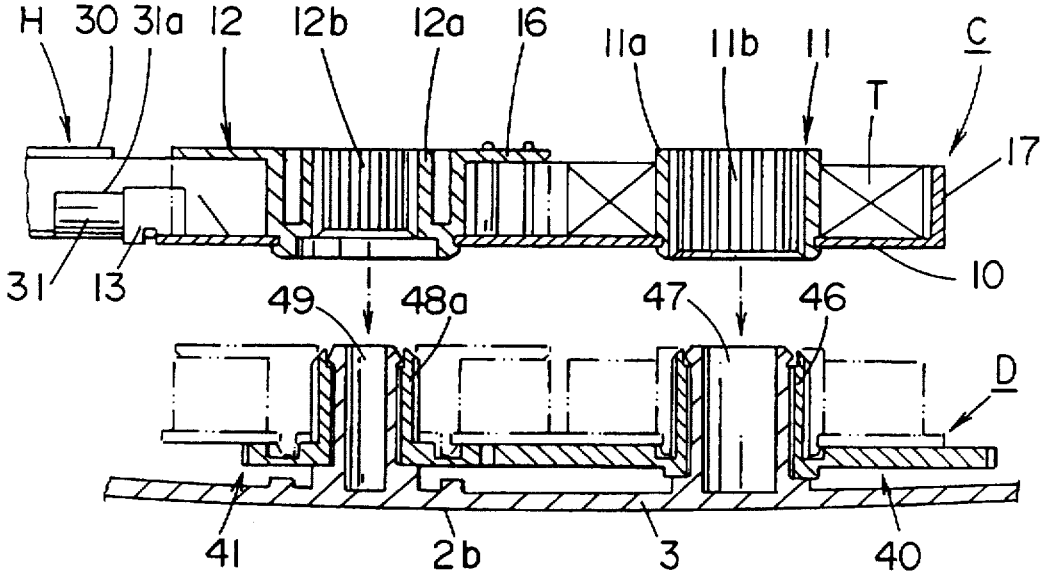
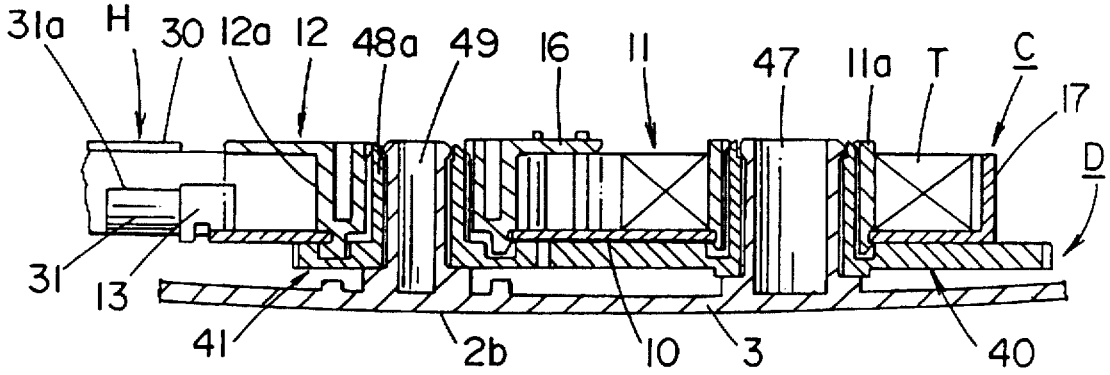
FIG. 6(b)

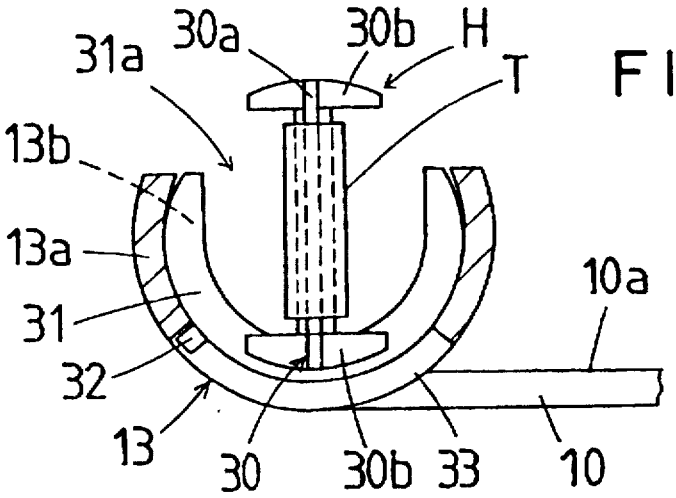
FIG. 10(a)
FIG. 10(b)
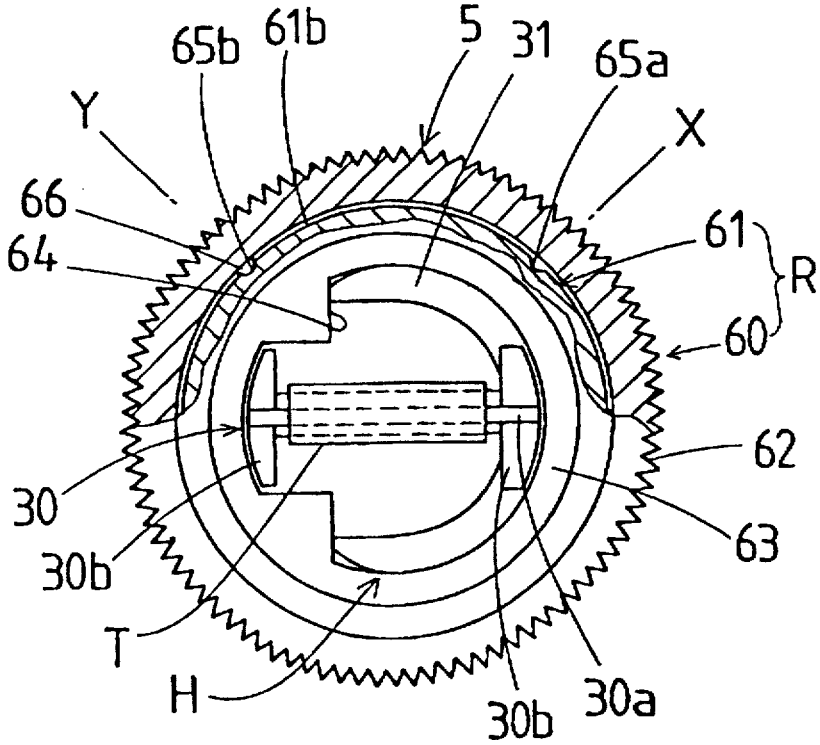

TAPE CARTRIDGE FOR COATING FILM TRANSFER TOOL AND COATING FILM TRANSFER TOOL CONTAINING THE CARTRIDGE

BACKGROUND OF THE INVENTION

1. Field of the Invention

The present invention relates to a tape cartridge for a coating film transfer tool and a coating film transfer tool containing the cartridge. It more particularly refers to a refill type coating film transfer tool which allows replacement of coating film transfer tapes. These tapes are suited for transferring such a coating film, comprising a corrective paint layer and an adhesive layer on the coating film transfer tape, to a sheet surface and the like.

2. Description of the Related Art

As examples of conventional coating film transfer tools, the inventors have already proposed a coating film transfer tool disclosed in Japanese Laid-open Patent No. 5-138097 and Japanese Laid-open Utility Model No. 5-13800, for example.

Both coating film transfer tools are used mainly as an erasing tool for correcting errors and the like, and comprise, referring to FIGS. 16(*a*) and 16(*b*), a pay-out reel (c) with a coating film transfer tape (b) wound thereabout and a take-up winding reel (d) for collecting the coating film transfer tape (b) after use these reels are provided rotatably in a case (a) that is intended to be held by hand for operation thereof as shown in FIGS. 16(*a*) and (*b*). In a leading end of the case (a), a projecting coating film transfer head (f) is provided for pressing the coating film transfer tape (b) onto a transfer area (correction area in a sheet surface) (e). The coating film transfer tape (b) paid out from the pay-out reel (c) is arranged such that it is dragged through the pressing part (g) in a leading end of the head (f) and windingly taken-up about the take-up winding reel (d).

In such a case, the case (a) is a depressed box that is geometrically and dimensionally sufficient for containing the pay-out reel (c) and take-up winding reel (d). Flat front and back surfaces of the case (a), that is, front and back surfaces with respect to the sheet surface (e) of FIGS. 16(*a*) and (*b*) provide gripping surfaces for manually operating the tool.

In a coating film transfer tool shown in FIG. 16 (*a*), the pressing part (g) in a leading end of the head (f) is arranged such that the coating film transfer tape (b) is guided as it is wound off the pay-out reel (c) and unto the take-up winding reel (d), and the tool is constructed for allowing so-called vertical pulling use that is suitable for correcting, for example, a part of a sentence written in a vertical line such as Japanese and the like. On the other hand, in a coating film transfer tool shown in FIG. 16(*b*), the pressing part (g) of the head (f) is arranged such that the coating film transfer tape (b) is guided generally facing against the gripping surface of case (a), and the tool is constructed for allowing so-called lateral pulling use that is suitable for correcting, for example, a part of a sentence written in a lateral line such as English and the like.

Then, in order to erase an error by using the coating film transfer tools, the gripping surfaces of case (a) are held by the user's fingers, and the case (a) is moved in the specified direction (shown by an arrow in FIG. 16 (*a*) or vertical to the sheet surface in FIG. 16(*b*)), respectively, while the coating film transfer tape (b) is tightly pressed against the correction area (e). In such a manner, a corrective paint layer carried by the coating film transfer tape (b) is applied onto the correction area (e) by the pressing part (g) of head (f), a letter or the like in the area is erased, and the used coating film (b) is collected by the take-up winding reel (d).

Effective use of the earth's natural resources has been particularly emphasized in these days, and it is desirable in a coating film transfer tool of this type to have a so-called refill type structure for allowing replacement of the coating film transfer tape (b) only, since, that is a consumable item, because saving of natural resources is demanded.

In this respect, in a coating film transfer tool of the vertical pulling type shown in FIG. 16(*a*), various tape cartridges replaceably employed in the case (a) are proposed. Such tape cartridges provided as a consumable supply, can generally be classified as structures composed of a combination of four components in total, that is, the coating film transfer tape (b), the pay-out reel (c), take-up winding reel (d) and the head (f) or a combination of only three components in total, that is the coating film transfer tape (b), the pay-out reel (c), and take-up winding reel (d).

In a tape cartridge of the former type, all four components (b), (c), (d) and (f) are provided in a plastic container, and a used cartridge containing them is completely replaced by a new cartridge. On the other hand, in a tape cartridge of the latter type, the three components (b), (c) and (d) are temporarily held by a holding member which is also removed in the replacement of a used tape cartridge.

However, either type of tape cartridge has the problem as described below, and further modification has been demanded.

That is, in the former structure, most of main components of the coating film transfer tool are replaced as consumable items, and all such components are housed in a plastic container, therefore, many components are used, the structure thereof is complex and bulky, and the cost of manufacturing the replacement parts themselves is high. Thus, the advantage of the refill type, interms of saving of natural resources and reduction of operating cost, cannot be sufficiently achieved. Besides, as the plastic container itself is relatively bulky because of its structure, it leads to an increase in size of the coating film transfer tool, and this is disadvantageous for providing portableness and easy operation.

In the case of the latter, because a holding member for temporarily holding the components is used, and replacement thereof is relatively complicated as well as troublesome, the user is required to be more or less familiar with the operation of the tool, and easy and proper replaceability cannot be assured, therefore, to all general users.

Moreover, in the coating film transfer tool of the lateral pulling type shown in FIG. 16(*b*), because the pressing part (g) of the head (f) guides the coating film transfer tape (b) with the tape generally facing against the gripping surface of the case (a), it has been practically impossible to provide a refill type structure for allowing replacement of the coating film transfer tape (b) only.

That is, in the coating film transfer tool, because of the structure, the coating film transfer tape (b) is necessarily twisted 90° in the head (f). Therefore, it is also difficult for a manufacturer to automatically assemble the tool, which is actually manually assembled by skilled workers.

On the other hand, in order to provide a refill type structure for allowing replacement of the coating film transfer tape (b) that is the consumable item, it is required that disassembly and assembly of a coating film transfer tool and replacement of the coating film transfer tape (b) are basically achieved by a user. Thus, it has been an essential issue to develop such a structure that the series of operations can be easily, rapidly and properly conducted by a general user to allow easy replacement of the coating film transfer tape (b).

BRIEF SUMMARY OF THE INVENTION

It is a primary object of the invention to provide a novel tape cartridge that eliminates the problems of a conventional coating film transfer tool.

It is other object of the invention to provide a tape cartridge comprising fewer components in a small and simple structure for achieving a compact coating film transfer tool and allowing easy, rapid and proper replacement.

It is a further object of the invention to provide a coating film transfer tool of the refill type to be used as a kind of stationery which allows easy replacement of coating film transfer tapes.

It is a different object of the invention to provide a coating film transfer tool of such a refill type for lateral pulling use.

The tape cartridge of the invention comprises a thin and flat support base, a rotatable pay-out reel provided on the support base and having a coating film transfer tape wound thereabout, a rotatable take-up winding reel provided on the support base for collecting the coating film transfer tape after use, and a coating film transfer head provided on the support base for pressing a coating film transfer tape on a transfer area, wherein the coating film transfer tape being paid out from the pay-out reel is wound on the take-up winding reel through a leading end, pressing part of the head, the both reels are engaged detachably, and are integrally rotatable with a pay-out rotating part and a take-up winding rotating part rotatably provided in the case, respectively, and the head is held, in a head holding part provided at the front end of the case, in a detachable and projecting manner.

Preferably, the support base is composed of a thin wall plate material having sufficient strength to hold both reels, the head corresponding to both of the rotating parts and the head holding part, and is structured so that one of its side surfaces can form a running guide surface for guiding the coating film transfer tape.

In the construction of the coating film transfer tool of the invention, the tape cartridge is provided detachably, the pay-out rotating part and take-up winding rotating part are rotatably provided in a hand-held case, the pay-out reel and take-up winding reel of the tape cartridge are detachably and integrally rotatably provided in both rotating parts, a head holding part for positioning and holding the coating film transfer head of the tape cartridge is held in the leading end of the case, and the case has a pair of confronting griping surfaces so as to be held by hand in a position similar to that of holding a writing tool.

Specifically, the head is not only constructed so as to be fixed at an angle for vertical pulling use, but is also constructed such that rotating operation is enabled between the coating film transfer tape replacement position and its application position, the leading end pressing part of the head guides, in the replacement position of the coating film transfer tape, the coating film transfer tape in the same attitude as it is wound about the pay-out reel and take-up winding reel, and the coating film transfer tape is guided, in the application position, almost opposite to the gripping surface of the case.

Herein, the coating film transfer tape being "almost opposite to the gripping surface of the case" means that the face and back sides of the coating film transfer tape nearly confront the gripping surface of the case. In other words, the face and back sides of the coating film transfer tape are directed almost in the same direction as the gripping surface of the case, that is, parallel to each other, and this meaning is same throughout the present specification.

Since the tape cartridge of the invention is mounted on the support base, the new and old cartridges are replaced together with the support base. In this case, while both reels are engaged with the pay-out rotating part and take-up winding rotating part of the main body of the case of the coating film transfer tool, and the head is set in the head holding part provided at the leading end of the main body of the case, the support base is mounted on the rotating parts, thereby completing the replacing job.

Owing to the structure in which the support base is composed of a thin wall flat plate and both of the reels and coating film transfer head are held only by this support base, the number of parts is reduced and the structure is small and simple, and hence the product cost is reduced and the entire coating film transfer tool is downsized.

Moreover, in the coating film transfer tool of the invention, the head is rotatable between the coating film transfer tape replacement position and its application position, and when the leading end pressing part of the head is in the coating film transfer tape replacement position, the coating film transfer tape is guided, while being wound on the pay-out reel and take-up winding reel, and the coating film transfer tape is guided almost opposite to the gripping surface of the case at the application position. Therefore in this construction, the two hitherto impossible requirements of lateral pulling use and replacement of coating film transfer tape, can be satisfied at the same time.

These and other objects and features of the invention will be better appreciated by reading the detailed description taken in conjunction with the accompanying drawings and novel facts setforth in the claims.

BRIEF DESCRIPTION OF THE DRAWINGS

FIG. 6(*a*) and 6(*b*) are sectional views for explaining a mounting procedure of the tape cartridge on a tape drive unit of the case main body in the erasing tool.

FIG. 10 shows a mounting structure of the coating film transfer head in the erasing tool, in which FIG. 10 (*a*) is a front view showing a partial section of the relation between the coating film transfer head and the head mounting part of the support base, with the coating film transfer head in the coating film transfer tape replacement position, and FIG. 10(*b*) is a partially cut-away front view showing the relation between the coating film transfer head and the rotating operating part of the case, with the coating film transfer head in the application position.

DETAILED DESCRIPTION OF THE PREFERRED EMBODIMENT

Figure 1:
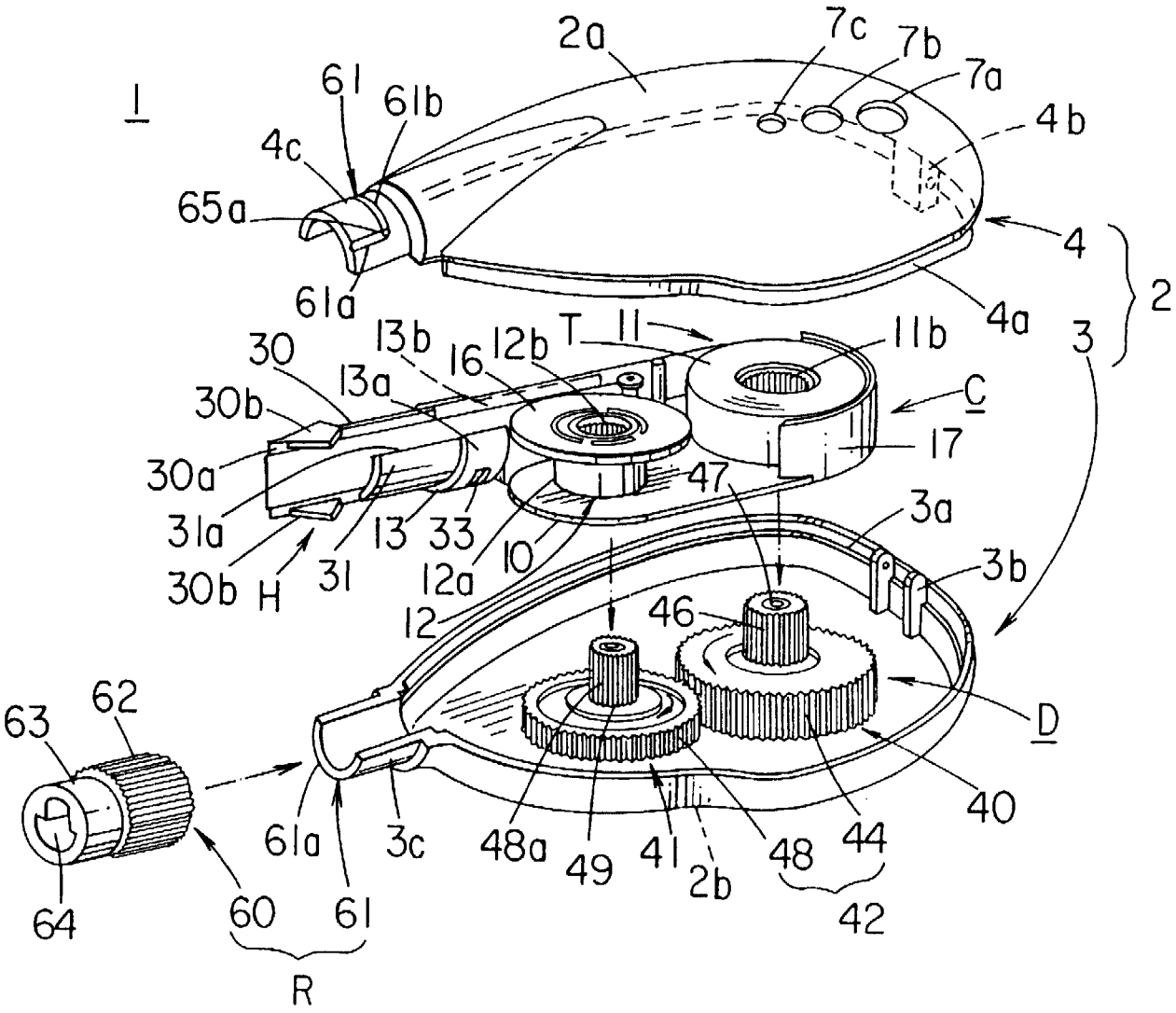
FIG. 1 is an exploded perspective view of an erasing tool as one of the embodiments of the invention.
Figure 2:
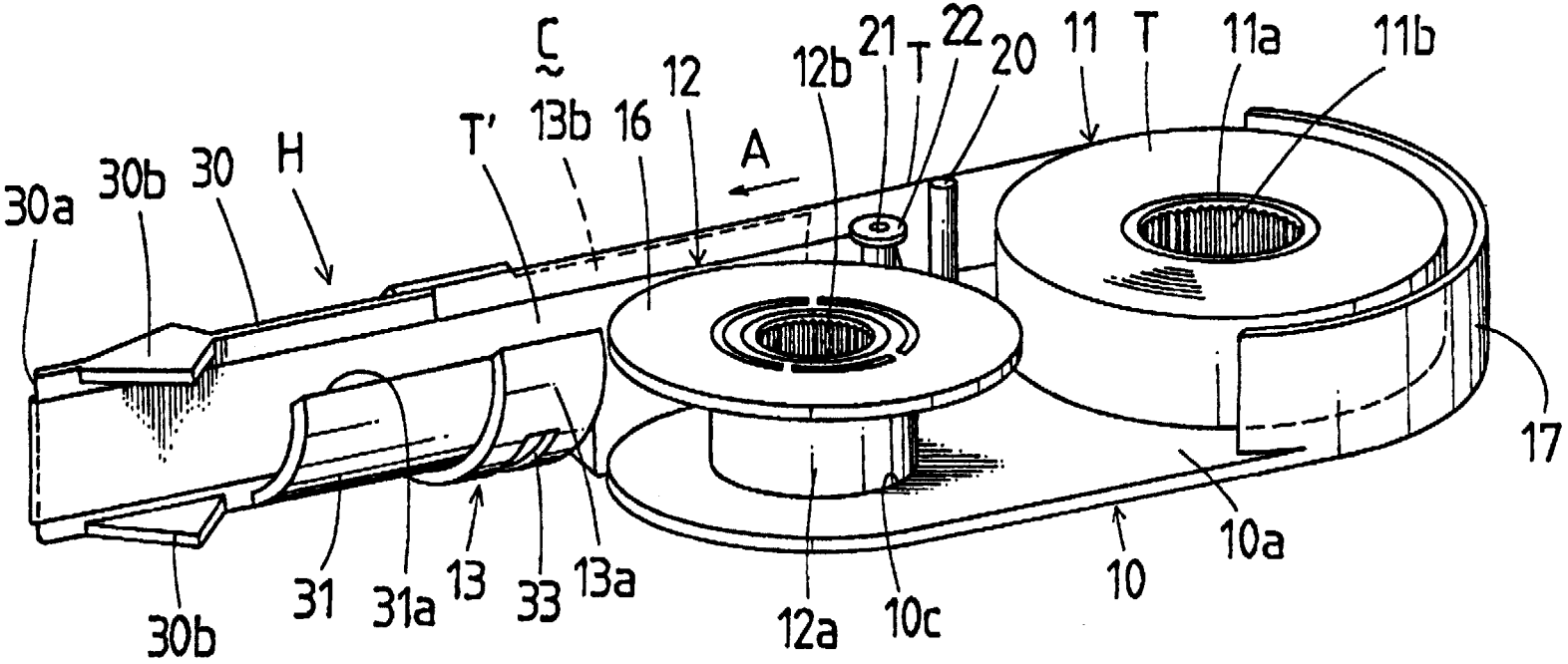
FIG. 2 is a perspective view showing a tape cartridge of the erasing tool.

An embodiment of the invention is described below by referring to the drawings.

FIGS. 1 to 14 show the tape cartridge and coating film transfer tool according to the invention, in which identical or similar components or elements are identified by the same reference numerals throughout the drawings.

In FIGS. 1 to 14, a coating film transfer tool according to an embodiment of the invention is shown. The coating film transfer tool 1 is particularly useful as an erasing tool for correcting errors or the like, and is of a cartridge type or refill type structure for allowing replacement of a coating film transfer tape T as a consumable supply.

The erasing tool 1 comprises, as shown in FIG. 1, a tape cartridge C having a coating film transfer head H, a tape driving part D, and a rotationally operated part R attached to a case 2, the tool can be hand-held for operation. In the erasing tool 1, the head H can be rotationally operated between a coating film transfer tape replacement position (and vertical pulling position) X shown in FIGS. 12(*a*) and 13(*a*) and an application position (lateral pulling position) Y in FIGS. 12(*b*) and 13(*b*). The component parts are described one by one below.

I. Case 2

The case 2 is formed in a flat box-like shape as shown, and has front contour and width dimensions sufficient for incorporating the tape cartridge C and tape driving part D. As described later, flat front and back surfaces 2*a*, 2*b* of the case 2 provide gripping surfaces for manually holding the tool during operation.

The case 2 is a plastic molding obtained by injection or other molding method, and comprises divided blocks of a main case body 3 and a cap 4. For this purpose, in an opening of the main case body 3, a fitting recess 3*a* is provided over the entire circumference thereof, and an engagement part 3*b* is provided at the rear end. A fitting rib 4*a* of the cap 4 is fitted to the fitting recess 3*a*, and an engagement claw 4*b* of the cap 4 is adapted to be engaged with the engagement part 3*b*. At the leading ends of the case main body 3 and cap 4, cylindrical halves 3*c* and 4*c*, to be combined integrally by a cap member 60, are provided respectively.

For assembling the case 2, first of all, the engagement claw 4*b* in the cap 4 is brought into engagement with the engagement part 3*b* in the case main body 3, and the cylindrical halves 3*c*, 4*c* are assembled and integrated with each other, while the fitting rib 4*a* is fitted into the fitting recess 3*a*, then the cap member 60 is fitted onto this assembled portion (cylindrical leading end) 6, thereby completing the assembly. Although not shown, instead of the engagement structure of the engagement part 3*b* and engagement claw 4*b*, the cap 4 may be pivotally connected to the case main body 3 so as to be free to open and close in a vertical direction.

The cap 4 has three remainder monitor windows 7*a* to 7*c* for monitoring the remaining amount of the coating film transfer tape T.

II. Tape cartridge C

The tape cartridge C is a component that is replaceable as a consumable item. Its detailed structure is shown in FIGS. 2 to 5. The tape cartridge C comprises a pay-out reel 11 with the coating film transfer tape T wound thereabout, a take-up winding reel 12 for collecting used coating film transfer tape T', and the coating film transfer head H for pressing the coating film transfer tape T onto a transfer area. All of these elements are mounted on a support base 10, and are detachably attached to the tape driving part D of the case main body 3 as shown in FIG. 6.

The support base 10 is composed of a thin flat plate, and its material and dimensions are selected to be as thin and compact as possible consistent with providing sufficient strength for holding the reels 11, 12 and the coating film transfer head H. In other words, the support base 10 is required to function for holding the reels 11, 12 and head H at corresponding positions only until they are attached to the tape driving part D and the cylindrical leading end 6 (shown in FIG. 9) as the head holding part. Therefore, the support base 10 is desired to be as thin and compact as possible, as long as the minimum strength for achieving its function is assured.

Figure 3:
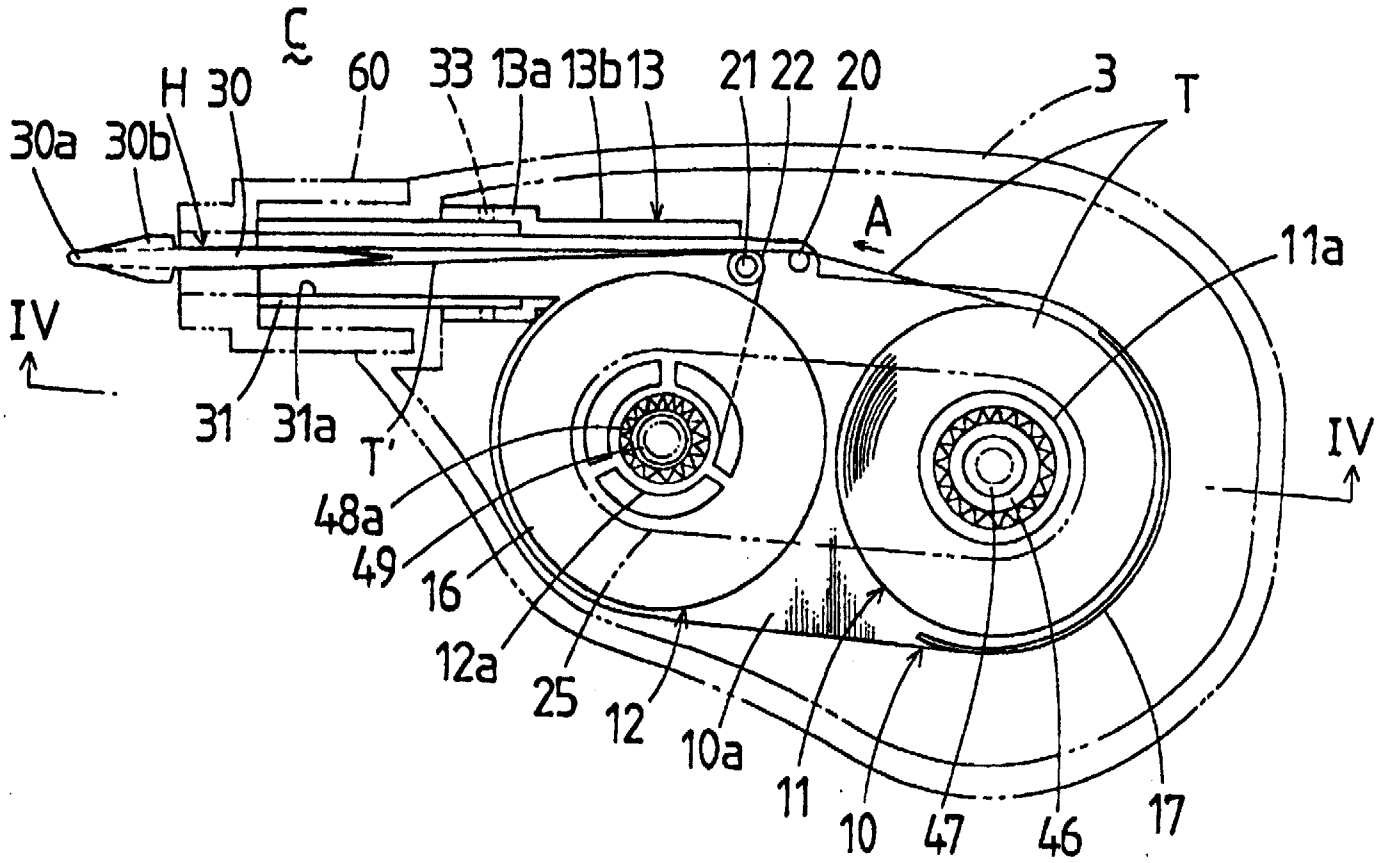
FIG. 3 is a front view of the tape cartridge.

In the illustrated embodiment, the support base 10 is made of AS (acrylonitrile-styrene) resin or ABS (acrylonitrile-butadiene-styrene) resin. The thickness of the front of the support base 10 is set at 1 mm or less. The shape of the support base 10 is nearly an oval form along the outer circumference of the reels 11 and 12, as shown in FIG. 3. At the leading end portion of the support base 10, a head mounting part 13 is integrally provided. A surface, or more particularly an upper surface 10*a*, of the support base 10 serves as a running and guiding surface for the coating film transfer tape T.

The pay-out reel 11 and take-up winding reel 12 are provided with hollow drum parts 11*a* and 12*a*, respectively, for winding the coating film transfer tape T thereabout. The drum parts 11*a* and 12*a* have, in their center, attachment holes 11*b* and 12*b* with tooth profile engagement parts as serrations or splines.

Figure 5:
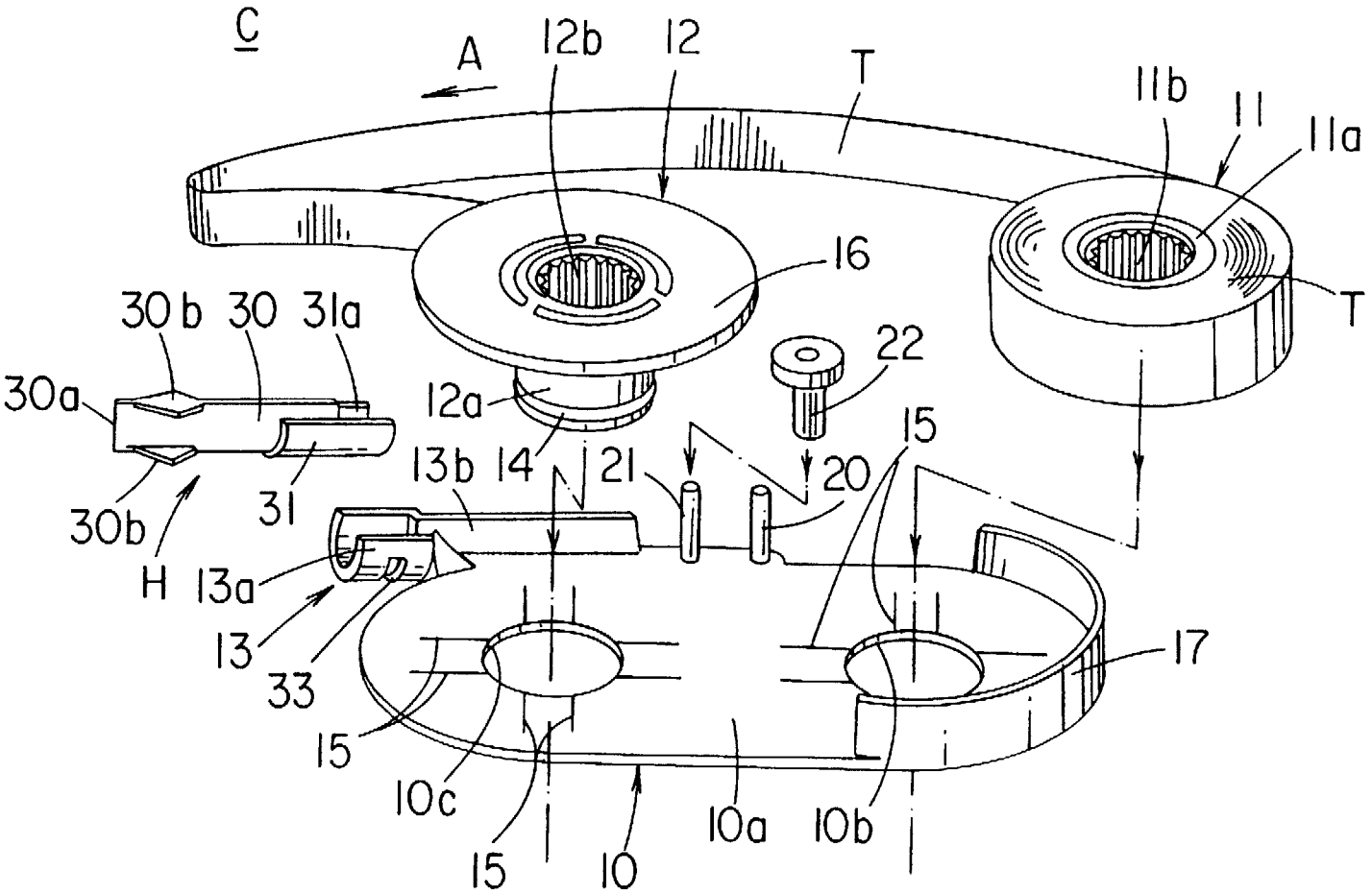
FIG. 5 is an exploded perspective view of the tape cartridge.

The drum parts 11*a* and 12*a* of the reels 11 and 12 are rotatably supported with support ends thereof in support holes 10*b* and 10*c* respectively of the support base 10. Specifically, annular fitting grooves 14,14 are formed in a support end of the drum parts 11*a* and 12*a*, respectively. These fitting grooves 14,14 are rotatably fitted and supported in an inner edge of the support holes 10 *b* and 10*c*. In this connection, in an outer circumferential part of the support holes 10*b* and 10*c*, as shown in FIG. 5, a plurality of slits 15, 15 . . . are radially extended for inserting the drum parts, respectively.

The coating film transfer tape T is wound about an outer circumference of the drum part 11*a* in the pay-out reel 11. The coating film transfer tape T is guided through the coating film transfer head H, and its leading end is connected to an outer circumference of the drum part 12*a* in the take-up winding reel 12.

The coating film transfer tape T consists of, for example, a film base (about 25 to 38 μm thick) of a plastic material, such as polyester or acetate films or paper, a release agent layer, such as vinyl chloride-vinyl acetate copolymer resin or low molecular polyethylene formed on one side thereon, a white corrective paint layer formed on the release agent layer an and adhesive (pressure sensitive adhesive) layer such as pressure sensitive polyurethane which has further applied thereon (detailed structure not shown). For the corrective paint layer, so-called dry type paint is employed. This allows writing in the corrected area immediately after the paint is transferred.

A free end of the drum part 11*a* in the pay-out reel 11 is left as an open end. A free end of the drum part 12*a* in the take-up winding reel 12 is provided with a guide flange 16 for running the tape.

Such a structure is employed because it is desired that, on the side of the pay-out reel 11, the free end of the drum part 11*a* should have no guide flange in order to wind the coating film transfer tape T during a manufacturing process, automatically, smoothly, and in mass production. On the other hand, the coating film transfer tape T can be smoothly paid out even without a guide flange at the free end of the drum part 11*a*. By contrast, on the side of take-up winding reel 12, the guide flange 16 is essential to smoothly take up the coating film transfer tape T'. Without the guide flange 16, it is difficult to wind the coating film transfer tape T' in alignment about the outer circumference of drum part 12*a*, because it goes out of control. In a worst case, if the coating film transfer tape T' becomes disposed on the outer circumference of the drum part 12*a*, it may disturb rotation of the winding reel 12, causing an inoperative condition for the erasing tool 1.

In order to avoid this, the support base 10 is provided with a tape protective wall 17 for protecting the outer circumference of the coating film transfer tape T wound about the pay-out reel 11. This tape protective wall 17 is a thin plate having a same thickness as the support base 10. The tape protective wall 17 is provided upright and integrally along the rear edge of the support base 10 so as to cover the outer circumference of the pay-out reel 11, or more specifically, to cover the outer circumference of the coating film transfer tape T wound thereabout.

By this tape protective wall 17, when assembling the tape cartridge C, the coating film transfer tape T is prevented from being accidentally, dislocated from the pay-out reel 11. When handling the tape cartridge C, this wall covers and protects the coating film layer, that is, the corrective paint layer, on the outermost surface of the coating film transfer tape T. This tape protective wall 17 may be provided at least over the shown range, from the viewpoint of reducing weight, downsizing and simplifying the structure of the tape cartridge C, but its specific forming range may be adequately varied depending on its purpose.

As shown in FIG. 6, the configuration of the reels 11 and 12 on the support base 10 is determined so that the attachment holes 11*b* and 12*b* are each coaxial, respectively, with the pay-out rotation part 40 and take-up winding rotation part 41 of the tape driving part D mentioned below.

Additionally, a pair of guide pins 20 and 21 are integrally provided upright, for guiding the coating film transfer tape T, on the support base 10 near the mounting positions of the reels 11 and 12. The guide pin 20 is for guiding the coating film transfer tape T paid out of the pay-out reel 11. The other guide pin 21 is for guiding the coating film transfer tape T' that is taken up on the winding reel 12.

Further, a collared guide roller 22 is freely rotatably pivoted on the guide pin 21 on the winding side. By means of such an arrangement, smooth and neat winding guide of the coating film transfer tape T' is encouraged, and if there is a coating film lever over on the coating film transfer tape T' due to transfer faire, the trouble of the coating film transfer tape T' being wound into the guide pin 21 can be avoided securely. A similar guide roller may be also attached to the guide pin 20 of the pay-out side.

Figure 4:
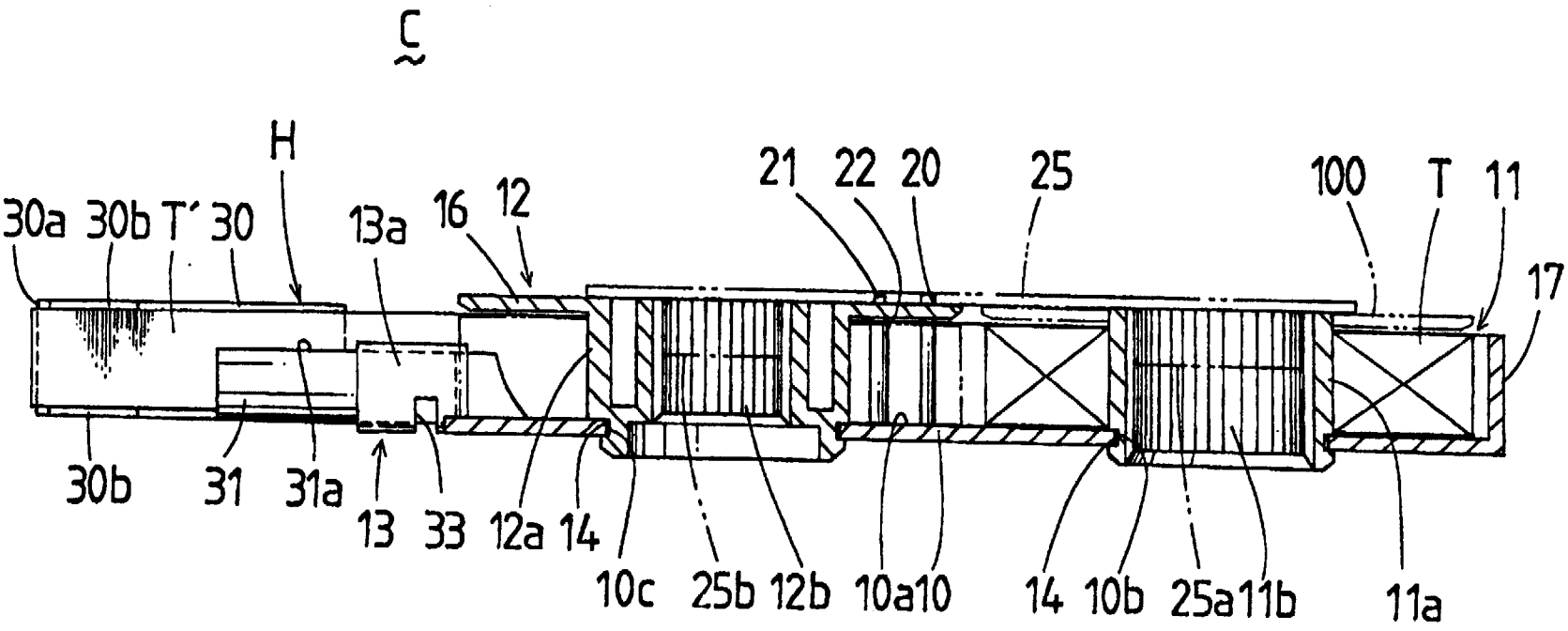
FIG. 4 is a sectional view along line IV—IV in FIG. 3 showing the tape cartridge.

Besides, to prevent loosening of the coating film transfer tape T before mounting, the pay-out reel 11 and winding reel 12 are prevented from rotating by a stopper 25 as indicated by double dot chain line in FIGS. 3 and 4. This stopper 25 is made of a material similar to that of the support base 10. The stopper 25 is formed in such a shape and has such dimensions, as shown in the figures, that it extends over the attachment holes 11*b*, 12*b* of reels 11, 12, and is provided with a pair of engagement projections 25*a*, 25*b* in a lower surface thereof. Then, by removable fitting engagement between the engagement projections 25*a*, 25*b* and the attachment holes 11*b*, 12*b*, respectively, the reels 11, 12 are stopped and held against rotation. The stopper 25 may be made of paper.

III. Coating film transfer head H

The coating film transfer head H is designed to press the coating film transfer tape T onto a correction area (transfer area) of an error or the like on the sheet of paper. This head H is mounted on a head mounting part 13 of the support base 10 and is rotatable about its axial center.

The head H is a plastic integral forming having a certain elasticity. The head H consists of a head main body 30 for guiding and pressing the coating film transfer tape T, and a bearing 31 for holding and rotating the body 30.

The head main body 30 is a thin plate slightly wider than the coating film transfer tape T. The head main body 30 is tapered in section so as to be gradually thin toward the leading end, and its leading end 30*a* is the pressing part for pressing the coating film transfer tape T. At both edges of the head main body 30, guide flanges 30*b*, 30*b* are formed for guiding the running of the coating film transfer tape T.

The bearing 31 is semicylindrical with an arcuate section and an open top as shown in FIGS. 5 and 10(*a*). In the central part of this semicylindrical bearing 31, the head main body 30 is formed integrally as shown in the drawing. The open part 31*a* of bearing 31 is a tape setting opening to the head main body 30. The tape setting opening 31*a* is disposed so that the coating film transfer tape T may be directly inserted in the state being wound about the reels 11, 12 when the head H is at the coating film transfer tape replacement position X, and it is designed so that setting of the coating film transfer tape T in the head main body 30 may be easy.

The base end portion of the bearing 31 is rotatably supported on the head mounting part 13, and the remaining leading end portion is rotatably supported on the cylindrical leading end 6 of the case 2 when mounting onto the case 2.

In addition, as shown in FIG. 10(*a*), in the mounting structure of the bearing 31 onto the head mounting part 13, a positioning protrusion 32 is projected on the outer circumference of the base end portion of the bearing 31. At the leading end 13*a* of the head mounting part 13 for supporting the bearing 31, an engagement opening 33 to be engaged with the protrusion 32 is extended in the circumferential direction.

By the engagement of the protrusion 32 and engagement opening 33, the head H is positioned in the axial direction in the head mounting part 31, and is mounted rotatably about its axial center. Hence, while maintaining a simple structure, the ease of operation when replacing the tape by the user is assured.

The rotational range of the head H in this case is defined by the circumferential length of the engagement opening 33 engaged with the protrusion 32, and in the illustrated example, more specifically, it is set corresponding to the rotational operation range of the head H by the rotationally operated part R mentioned later.

Consecutively to the leading end 13*a* of the head mounting part 13, a mounting part main body 13*b* is provided. This mounting part main body 13*b* has an inside cylindrical guide surface corresponding to the inside cylindrical surface of the bearing 31, thereby a tape guide part for guiding the coating film transfer tape T in cooperation with the guide pins 20, 21 is formed. This tape guide part 13*b* makes the job easy and secure when setting the coating film transfer tape T on the guide pins 20, 21 and head H when assembling the tape cartridge C. Moreover, similar to the tape protective wall 17, the tape guide part 13*b* prevents the coating film transfer tape T from being dislocated unexpectedly from the setting state, and covers and protects, the coating film layer on the outermost surface of the coating film transfer tape T when handling the tape cartridge C, that is, the corrective paint layer.

In the thus constituted tape cartridge C, as shown in FIG. 6(*a*), (*b*), it is set in one step by mounting the support base 10 on both rotation parts 40, 41 while engaging both reels 11, 12 with the both rotation parts 40, 41 of the tape driving part D and engaging the head H with the cylindrical half 3*c* of the case main body 3 from the upper side, respectively. On the other hand, by directly lifting the support base 10 to the upper side, the reels 11, 12 and head H can be easily detached instantly from the rotation parts 40, 41 and cylindrical half 3*c*, respectively.

IV. Tape driving part D

Figure 7:
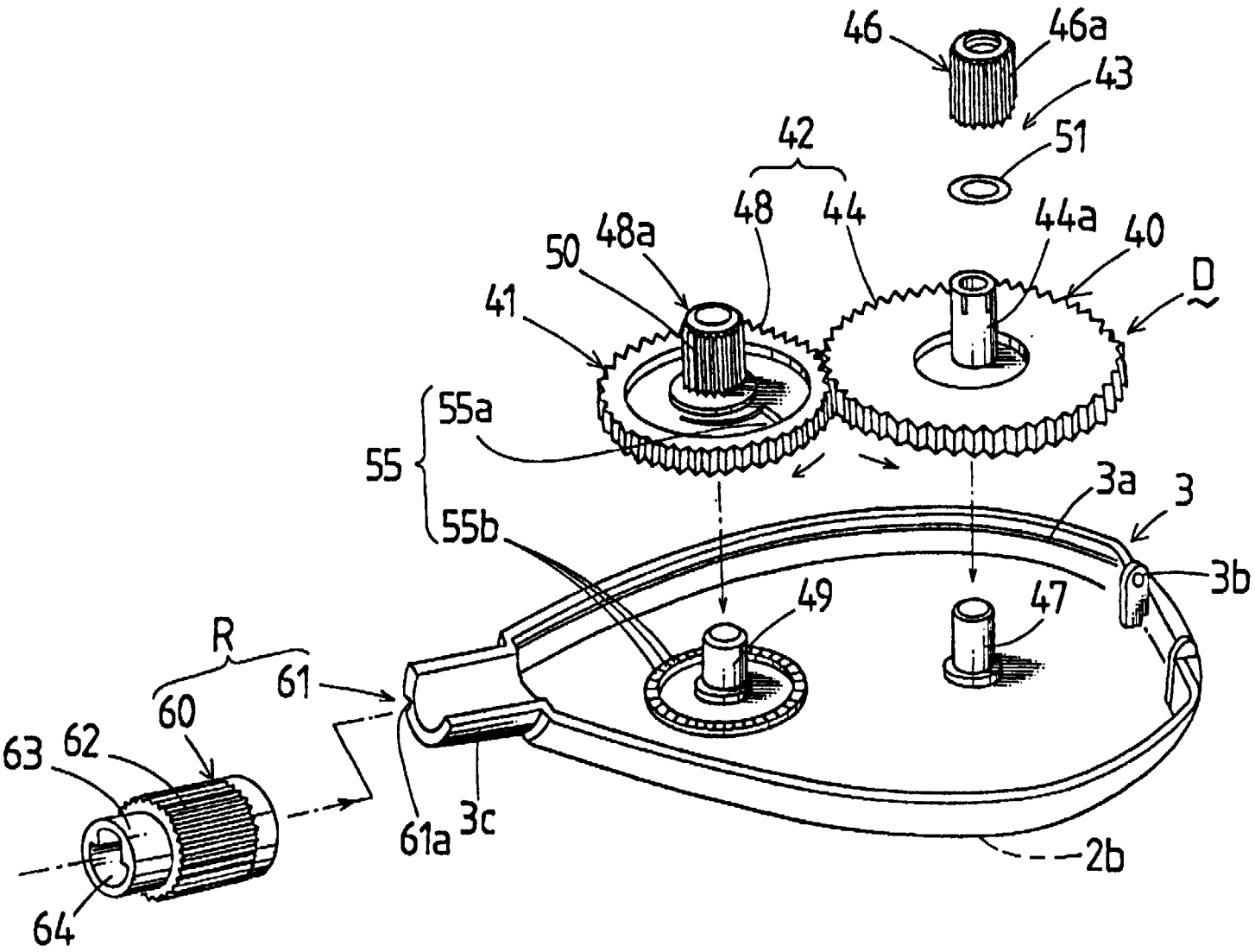
FIG. 7 is an exploded perspective view of the internal structure of the case main body in the erasing tool.

The tape driving part D is provided in the main case body 3. The tape driving part D comprises mainly, as shown in FIGS. 6 and 7, a pay-out rotation part 40 for rotatably driving the pay-out reel 11, a winding rotation part 41 for rotatably driving the take-up winding reel 12, an interlocking part 42 for interlocking the rotation parts 40, 41, and a clutch mechanism 43.

The pay-out rotation part 40 comprises a drive side rotary gear 44 for composing the interlocking part 42, and a driven member 46.

A hollow rotary shaft 44*a* of the drive side rotary gear 44 is rotatably borne on a hollow support shaft 47 provided upright on the inner side of the case main body 3. At the leading end of the hollow support shaft 47, a stopper is provided for preventing the rotary shaft 44*a* from slipping out.

The driven member 46 includes a tape winding part together with the drum 11*a* of the pay-out reel 11, and is formed in a hollow cylindrical shape. This driven member 46 is rotatably provided on the rotary shaft 44*a* of the drive side rotary gear 44. On the outer circumference of the driven member 46, a toothed engagement part 46*a* such as serrations and splines are formed as shown in the drawing. At the leading end of the rotary shaft 44*a*, a stopper is provided to prevent the driven member 46 from slipping out.

The winding rotation part 6 has a driven side rotary gear 48 for the interlocking part 42. A hollow rotary shaft 48*a* of the rotary gear 48 is rotatably borne on a hollow support shaft 49 provided upright on the inner surface of the case main body 3. At the leading end of the hollow support shaft 49, a stopper is provided for preventing the rotary shaft 48*a* from slipping out. On the outer circumference of the rotary shaft 48*a*, a toothed engagement part 50 such as serrations and splines are formed.

The interlocking part 42 is composed of the drive side rotary gear 44 and driven side rotary gear 48. Both rotary gears 44, 48 are engaged with each other at a specific gear ratio. Accordingly, the winding rotation part 41 is always interlockingly rotated with the pay-out rotation part 40 at a specific rotation ratio. This rotation ratio, that is, the gear ratio of both gears 44 and 48 is determined so that the coating film transfer tape T may be paid out and wound smoothly, based upon the winding diameters of the coating film transfer tape T on the pay-out reel 11 and take-up winding reel 12.

The clutch mechanism 43 is designed to synchronize the pay-out speed and winding speed of the coating film transfer tape T in the pay-out reel 11 and take-up winding reel 12, and is provided in the pay-out rotation part 40.

Figure 8:
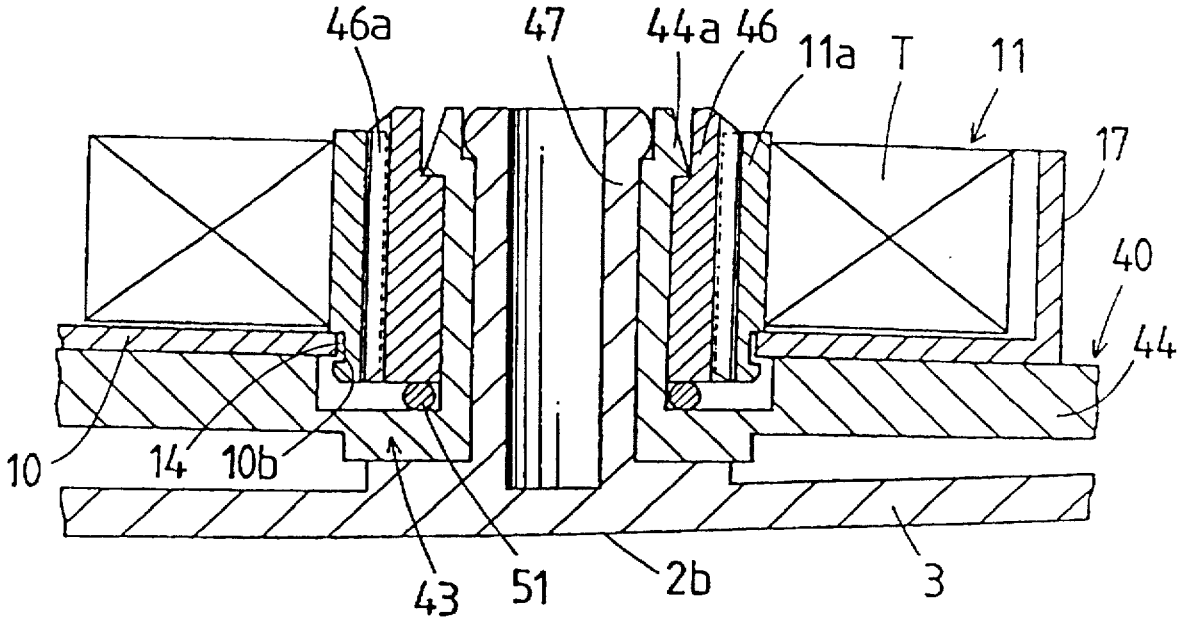
FIG. 8 shows a clutch mechanism in the erasing tool, in which FIG. 8(*a*) is a sectional view, and FIG. 8(*b*) is a perspective view showing a friction member of the clutch mechanism.
Figure 8B:
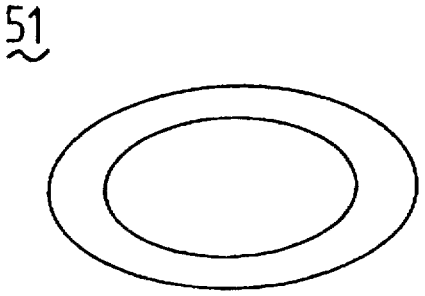

A specific constitution of the clutch mechanism 43 is shown in FIG. 8(*a*). The clutch mechanism 43 has a friction member 51 interposed between the drive side rotary gear 44 and driven member 46.

As the friction member 51, an elastomer O-ring as shown in FIG. 8(*b*) is used. The O-ring 51 is a power transmission part between the drive side rotary gear 44 as the rotation driving part, and the driven member 46 as the tape winding part 45. This O-ring 51 is specifically a silicone rubber ring having a circular section. The O-ring 51 is elastically interposed between the confronting end surfaces in the axial direction of both members 44, 46, and these three members contact mutually in a frictional engagement state.

Therefore, in power transmission of the clutch mechanism 43, the frictional force by thrust load acting between both members 44, 46 is utilized. This frictional force is set to the optimum value mainly by properly adjusting the distance between the engagement surfaces of both members 44, 46, and the diameter of the section of the O-ring 51.

As shown in FIG. 7, the winding rotation part 41 is further furnished with a reverse rotation preventive mechanism 55 for preventing reverse rotation of both reels 11, 12. This reverse rotation preventive mechanism 55 consists mainly of a detent claw 55*a* provided in the driven side rotary gear 48, and multiple reverse rotation preventive claws 55*b*, 55*b*, . . . provided in a concentric annular form with the hollow support shaft 49 at the inner side of the case main body 3. Therefore, when the reels 11, 12 rotate in the arrow direction, the detent claw 55*a* rides over the reverse rotation preventive claws 55*b*, 55*b*, . . . while deforming elastically, and permits the normal rotation. On the other hand, when the reels 11, 12 rotate in the reverse direction of the arrow direction, the detent claw 55*a* is engaged with any one of the reverse rotation preventive claws 55*b*, 55*b*, . . . , and blocks the reverse rotation. This reverse rotation preventive mechanism 55 may be provided in the drive side rotary gear 44.

Although not shown in the drawings, in relation to the reverse rotation preventive mechanism 55, a conventional rewinding mechanism may be provided in the tape driving part D for correcting the looseness of the coating film transfer tape T.

Accordingly, by pressing action of the coating film transfer head H described later, when a tensile force (in the direction of arrow A) applied to the coating film transfer tape T acts as a rotational torque to the pay-out reel 11, the drive side rotary gear 44 is rotated through the tape winding parts 11*a* and 46 of the pay-out reel 11, and clutch mechanism 43. The rotational torque effects rotation of the driven side rotary gear 48 and further the take-up winding reel 12 in interlock through the interlock part 42, thereby winding up the coating film transfer tape T' automatically after use.

In this case, the ratio of rotation (corresponding to the ratio of outer diameters) between the drive side rotary gear 44 and driven side rotary gear 48 is unchanged at any time, while the ratio of the outer diameter between the coating film transfer tape T about the pay-out reel 11 and the coating film transfer tape T' about the take-up winding reel 12 changes in the course of time, and is not constant. It means that the outer diameter of the coating film transfer tape T about the pay-out reel 11 is gradually reduced as the tape is used, while the outer diameter of the coating film transfer tape T' about the take-up winding reel 12 is correspondingly increased.

Therefore, the winding speed of the take-up winding reel 12 is increased in comparison with the pay-out speed of pay-out reel 11 as time elapses, and the synchronism of the two speeds is broken and the rotational torque acting on the pay-out reel 11 is also gradually increased. Then, the rotational torque overcomes the frictional force of the clutch mechanism 43, and the tape winding parts 11*a*, 46 slip and rotate relatively on the drive side rotary gear 44. As a result, the rotational torque difference between the reels 11 and 12 is canceled, and the pay-out speed and winding speed are mutually synchronized, thereby assuring smooth running of the coating film transfer tape T.

V. Rotationally operated part R

The rotationally operated part R is for rotationally operating the head H of the tape cartridge C. The rotationally operated part R comprises a cap member 60 as an operating member detachably attached to the cylindrical leading end 6, and a positioning part 61 provided on an outer circumference of the cylindrical leading end 6.

The cap member 60 is an integral molding of plastic material, and comprises a base part 62 fitted over the cylindrical leading end 6, and an engagement part 63 integrally engaged with the head H in the rotating direction.

The base part 62 serves as an assembly fixing member for the case 2 and as a rotationally operated part. A cylindrical bore of the base part 62 is set so that it can be rotatably fitted over the outer circumference of cylindrical leading end 6, and that multiple toothed anti-slip ribs are formed on an outer circumference thereof as shown in the drawing. The engagement part 63 is provided with a through hole 64 for receiving the head H. The shape and dimension of the through hole 64 are set so that the cap member 60 and the head H are integrally engaged with each other in the rotating direction, when the head H is inserted, as shown in FIG. 10(*b*).

The positioning part 61 is for resiliently positioning and fixing the cap member 60 in position in the direction of rotation. A pair of positioning parts 61, 61 are provided at confronting positions on the outer circumference of the cylindrical leading end 6. The pair of positioning parts 61, 61 are identical in structure, and the positioning part 61 on the side of cylindrical half 4*c* in the cap 4 is described below.

Figure 9A:
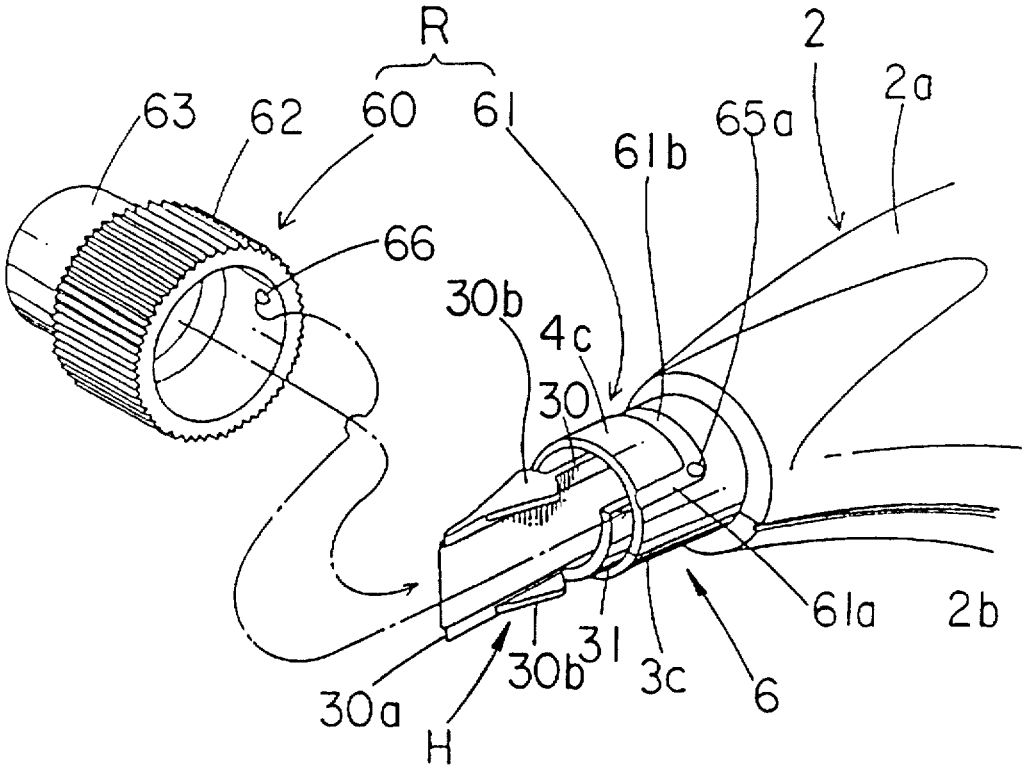
FIG. 9 is a perspective view showing the structure of the rotating operating part in the erasing tool, in which FIG. 9(*a*) shows the relation between the coating film transfer head and the rotationally operated part, and FIG. 9(*b*) shows the positioning part of the rotationally operated part.
Figure 9B:
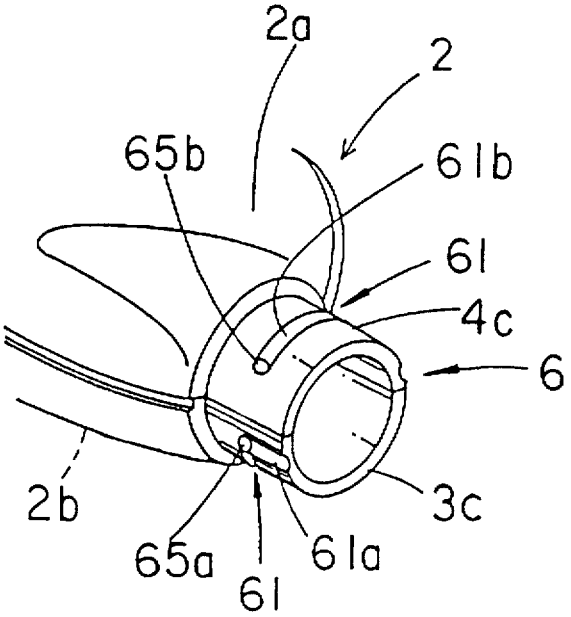

The positioning part 61 comprises, as shown in FIG. 9, a fit-in guide groove 61*a* extending linearly in the axial direction of the cylindrical leading end 6, and an anchor guide groove 61*b* extending from an end of the fit-in guide groove 61*a* in the circumferential direction of the cylindrical leading end 6. In the embodiment shown, the anchor guide groove 61*b* is formed in a range of central angle of 90° of the cylindrical leading end 6, as shown in FIG. 10(*b*). Moreover, first and second engagement parts 65*a* and 65*b* are provided at both ends of the anchor guide groove 61*b*.

The first and second engagement parts 65*a* and 65*b* are formed as recesses deeper than the guide grooves 61*a*, 61*b*. The engagement recesses 65*a*, 65*b* are disengageably engaged with an engagement projection 66 that is provided on an inner circumference of the cap member 60. In other words, the shape and dimension of the engagement projection 66 are set so that it is guided along the guide grooves 61*a*, 61*b*, while it is elastically changed in shape to some relative extent, and fitted in the engagement recesses 65*a*, 65*b* through elastic restoration.

The engagement projection 66 and engagement recesses 65*a*, 65*b* are positionally set for engagement with each other in such a relation as described below.

Figure 12A:
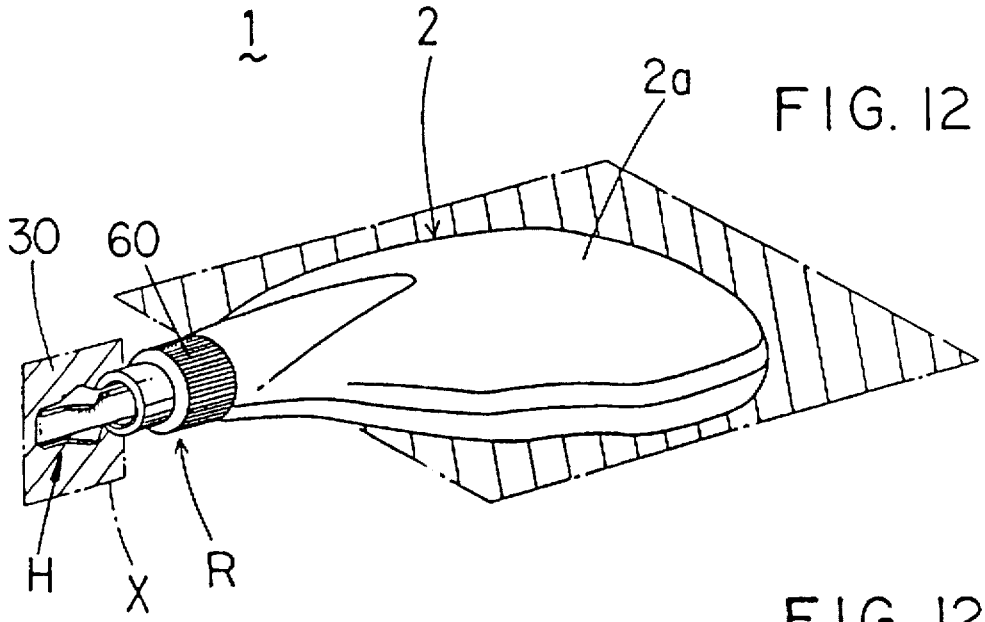
FIG. 12 is a perspective view showing the appearance of the erasing tool, in which FIG. 12(*a*) shows the state of the coating film transfer head in the coating film transfer tape replacement position, and FIG. 12(*b*) shows the state of the coating film transfer head in the application position.
Figure 12B:
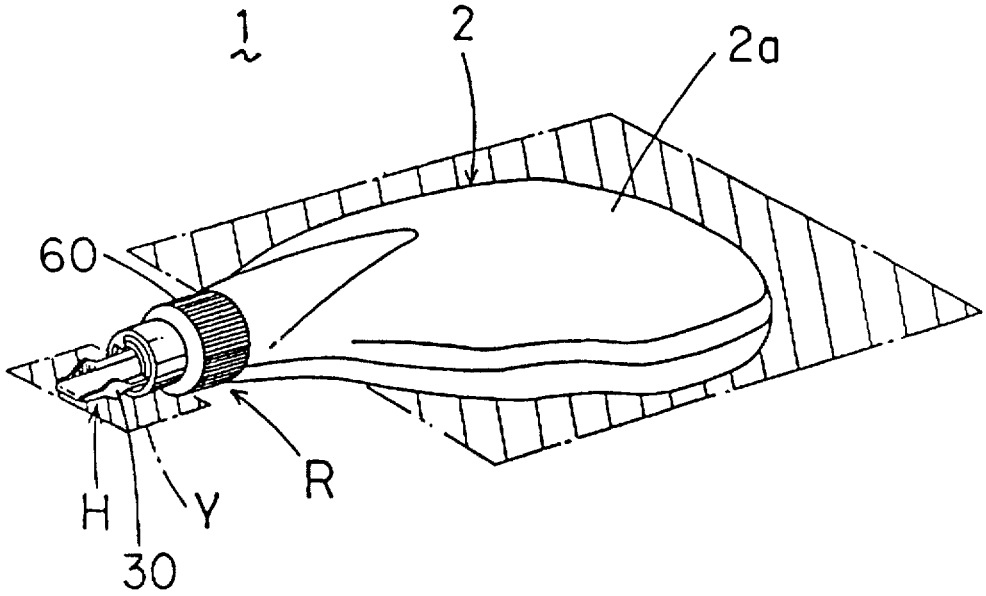
Figure 13A:
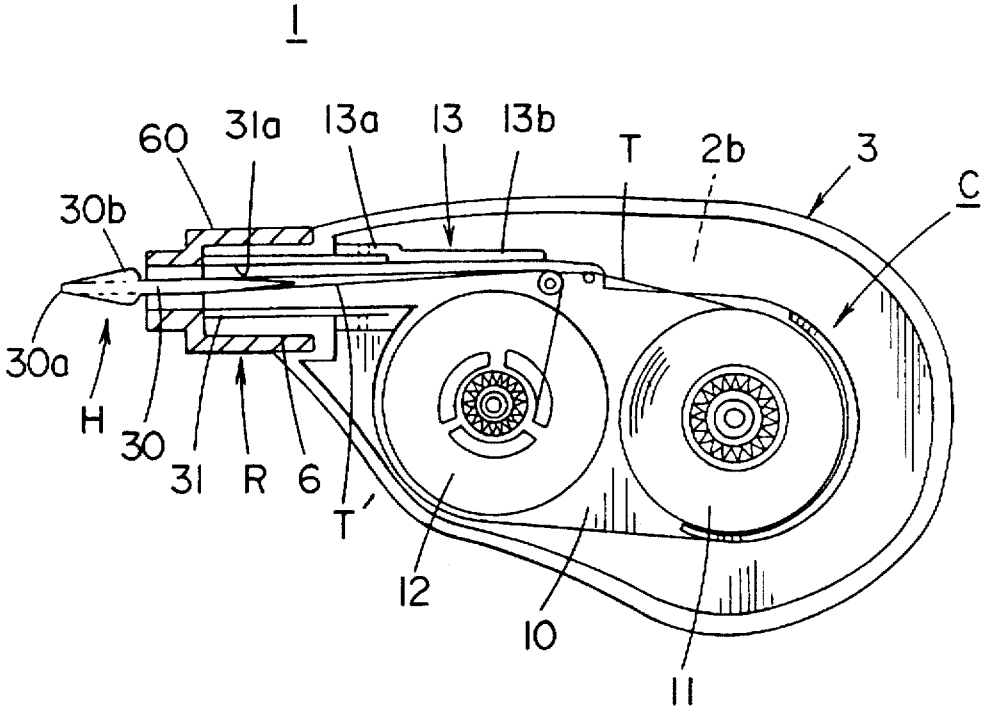
FIG. 13 is a front view showing the inside of the erasing tool, in which FIG. 13(*a*) shows the state of the coating film transfer head in the coating film transfer tape replacement position, and FIG. 13(*b*) shows the state of the coating film transfer head in the application position.
Figure 13B:
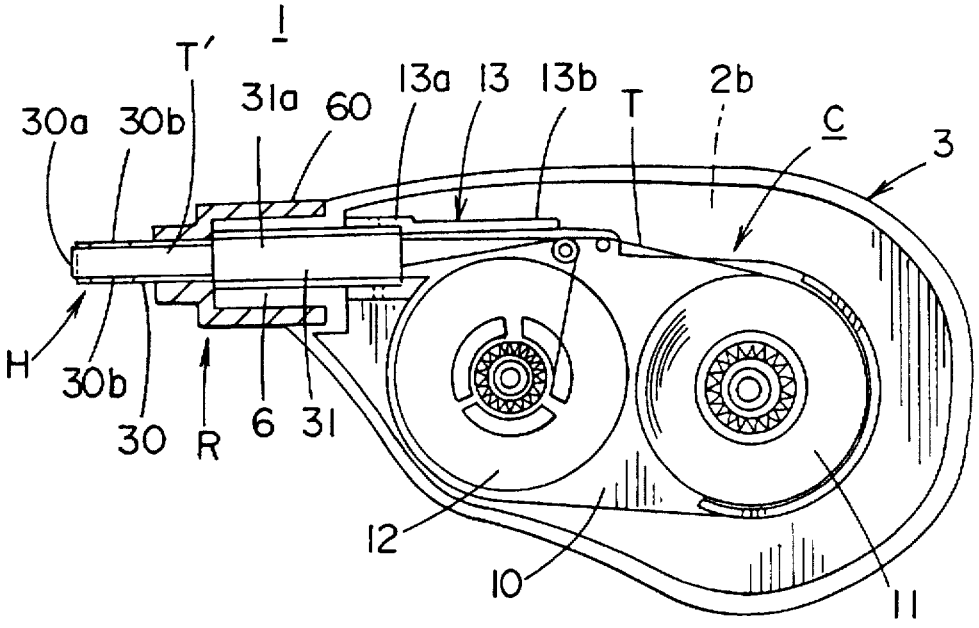

That is, when the engagement projection 66 of cap member 60 is in engagement with the first engagement recess 65*a*, the head H is in a coating film transfer tape replacement position (vertical pulling position) X, as shown in FIGS. 12(*a*) and 13(*a*). In such a state, the pressing part 30*a* of head H guides the coating film transfer tape T in a same attitude as it is wound about the pay-out reel 11 and winding reel 12, that is, with front and back surfaces of the coating film transfer tape T oriented generally perpendicularly (orthogonally) to the gripping surfaces 2*a*, 2*b*.

On the other hand, when the engagement projection 66 is in engagement with the second engagement recess 65*b* (see FIG. 10(*b*)), the head H is, as shown in FIGS. 12(*b*) and 13(*b*), in an application position (lateral pulling position) Y. In such a state, the pressing part 30*a* of head H guides the coating film transfer tape T in such an attitude that it is generally faced against the gripping surfaces 2*a*, 2*b* of case 2, that is, with the front and back surfaces of coating film transfer tape T facing in the direction approximately the same as that of (in parallel with) the gripping surfaces 2*a*, 2*b*.

Figure 11A:
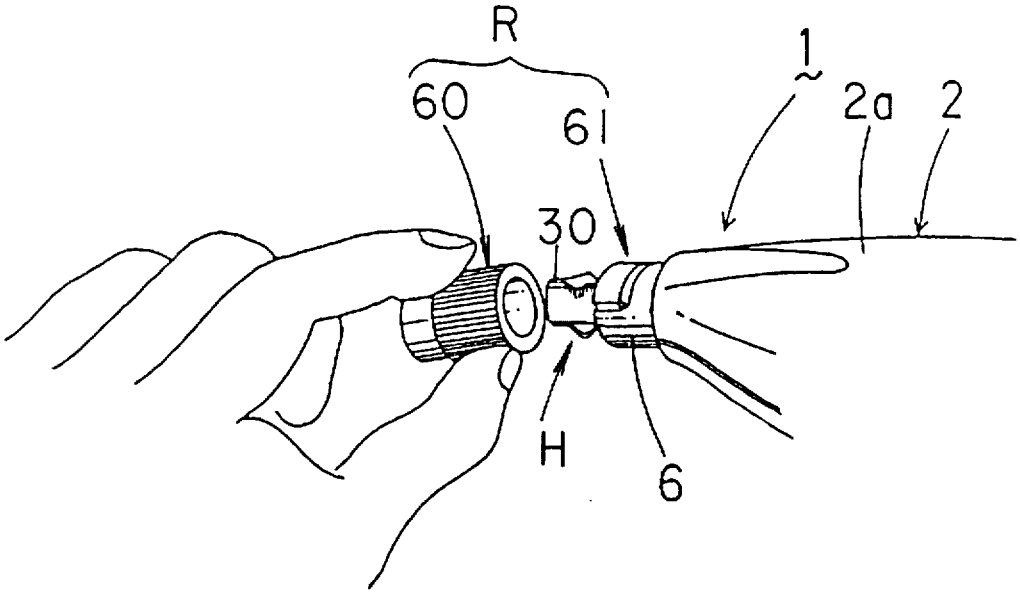
FIG. 11 is a perspective view for explaining an operating procedure of the rotationally operated part, in which FIG. 11(*a*) shows the state of mounting a cap member on a cylindrical leading end of the case, and FIG. 11(*b*) shows the state of rotating and operating the cap member.
Figure 11B:
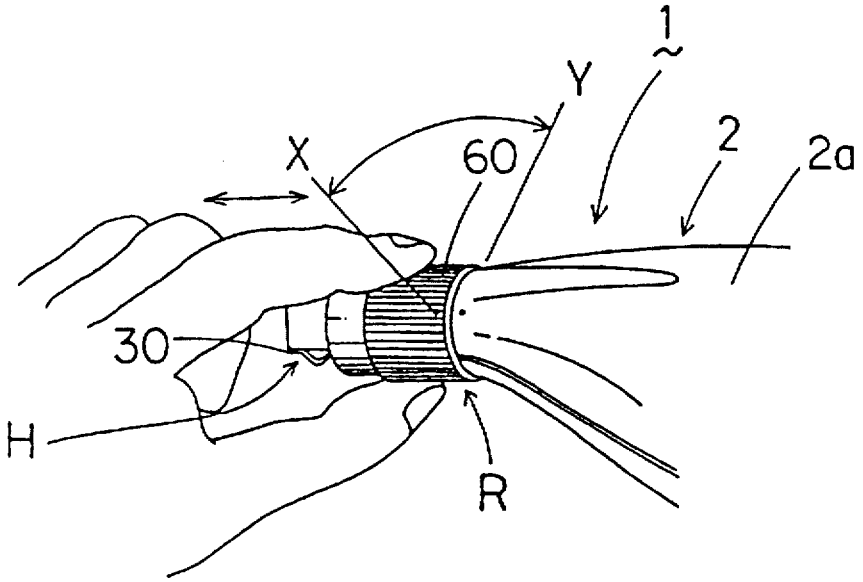

In this way, when the head H is at the coating film transfer tape replacement position X, the cap member 60 is fitted onto the cylindrical leading end 6 of the case 2 as shown in FIG. 11(*a*), and from this state, by rotating and operating the cap member 60 together with the head H from the coating film transfer tape replacement position X to the application position Y, the case 2 is assembled and fixed.

Now, operation of the erasing tool 1 constructed in such a manner is described below.

A. Operation

As shown in FIG. 11(*b*), the tool 1 can be used in two different ways by rotating the cap member 60, and selectively positioning the head H in one of two positions, the vertical pulling position X (see FIGS. 12(*a*) and 13(*a*)) and lateral pulling position Y (see FIGS. 12(*b*) and 13(*b*)).

Figure 14A:
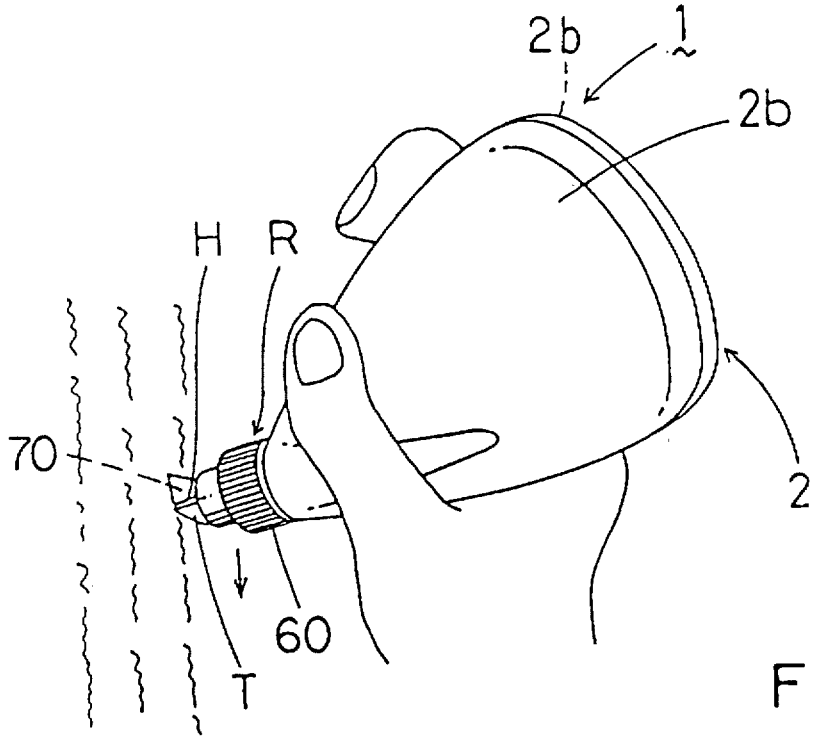
FIG. 14 is a perspective view for explaining the method of use of the erasing tool, in which FIG. 14(*a*) shows the state of the tool for vertical pulling use, and FIG. 14(*b*) shows the state of the tool for lateral pulling use.
Figure 14B:
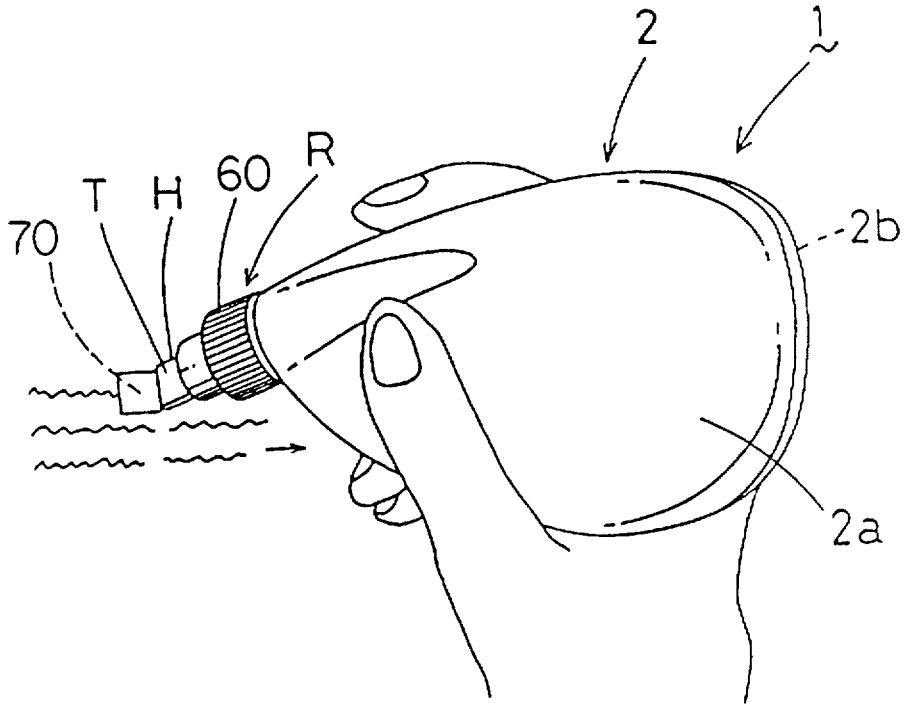

(i) Vertical pulling use (See FIG. 14(*a*))

This is suitable for partially correcting a sentence written vertically, for example, in Japanese. For such a operation, as shown in the figure, the gripping surfaces 2*a*, 2*b* of case 2 are held by a user like a writing tool, and in this state, the pressing part 30*a* of head H is brought into contact with the starting end (upper end) of a correction area (transfer area)

70 containing an error or the like to be corrected on a sheet surface. Then the case 2 is moved vertically or downward in relation to the sheet surface, and stopped at the terminal end (lower end) of the correction area 70.

In such an operation, the corrective paint layer (white) of coating film transfer tape T in the pressing part 30*a* of head H is separated from the film base, and transferred to cover the correction area 70. The error or the like of the correction area 70 is thereby erased, and a correct letter can be readily written thereon.

(ii) Lateral pulling use (See FIG. 14(*b*))

This is suitable for partially correcting a sentence written laterally, for example, in English. For such operation, as shown in the figure, the gripping surfaces 2*a*, 2*b* of case 2 are held by used like a writing tool, and the pressing part 35*a* of head H is brought into contact with the starting end (left end) of a correction area 70 with the tool held, as described above. Then, by moving the case 2 laterally or rightward in relation to the sheet surface, and stopping it at the terminal end (right end) of the correction area 70, an error or the like is erased, and a correct letter can be readily written thereon.

B. Replacement of tape cartridge C

When the coating film transfer tape T is completely used, and wound-up on the take-up winding reel 12 after being paid-out from the pay-out reel 11, the tape cartridge C should be replaced with a new one according to the following steps.

(i) The case 3 is disassembled and opened. First, the cap member 60 is drawn out from the cylindrical leading end 6 of the case 2 as shown in FIG. 11(*a*).

In this case, when the head H is at the vertical pulling operation position, that is, at the coating film transfer tape replacement position X, the cap member 60 can be pulled out directly. On the other hand, when the head H is at the lateral pulling operation position Y, by rotating the cap member 60, the head H is pulled out after rotating from the lateral pulling operation position Y to the coating film transfer tape replacement position X.

In succession, when the cap 4 is at the upper side, the cylindrical half 4*c* is lifted to the upper side, and the cap 4 is detached from the case main body 3, or opened.

(ii) The used tape cartridge C (empty pay-out reel 11+take-up winding reel 12 having used coating film transfer tape T+head H) is directly taken out of the case main body 3.

That is, by lifting the support base 10 directly to the upper side, the pay-out reel 11, take-up winding reel 12, and head H are simultaneously detached from the pay-out rotation part 30 and winding rotation part 31 of the tape driving part D, and the cylindrical half 3*c* of the case main body 3.

(iii) A new tape cartridge C (pay-out reel 11 holding a new coating film transfer tape T+take-up winding reel 12+head H) is mounted on the case main body 3 in the above procedure.

That is, the guide pins 20, 21, and head H are provided in the support base 10, and setting of the coating film transfer tape T on the guide pins 20, 21 and head H is already completed in the production step of tape cartridge C. Therefore, when replacing this tape, it is only necessary to set the tape cartridge C in the case main body 3.

(iv) Then by assembling the case 2 again in the reverse procedure of the above, replacement of used and new tape cartridges is over.

As shown in the drawing, since the rotating range of the head H is set corresponding to the rotational operation range of the head H by the cap member 60, even for an inexperienced user, it is easy and secure to position the head H into the cylindrical half 3*c* in step (iii) and rotate the cap member 60 in succeeding step (iv). Hence, ease of operation for replacing the tapes is assured, and misoperation is effectively prevented.

The embodiment described above is only a preferred mode of carrying out the invention, and it is appreciated that the invention is not limited thereto, and various design modifications may be made in the invention without departing from the spirits and scope thereof. For example, modifications described below are possible.

Tape cartridge C (1) By employing a film base formed in one side thereof with an adhesive layer over a release agent layer as the coating film transfer tape T, the tool can be used as an adhesive applicator for transferring only the adhesive layer to a sheet surface and the like.

Figure 15:
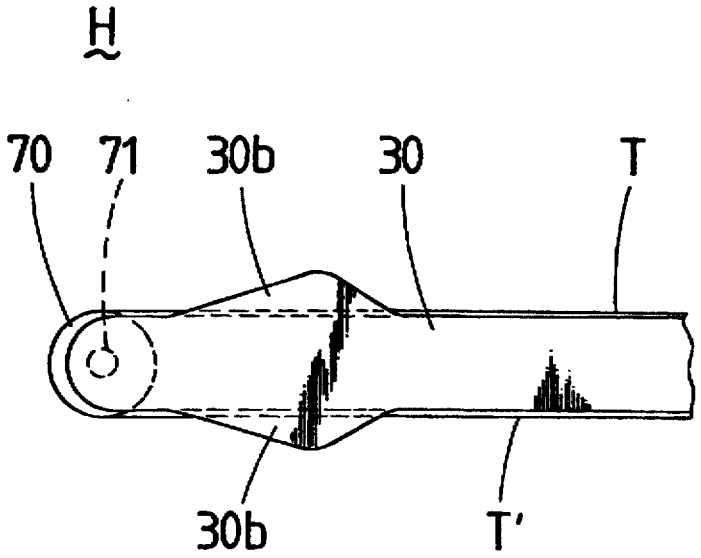
FIG. 15 is a magnified side view showing a modified example of the leading end pressing part of the coating film transfer head of the erasing tool.
Figure 16A:
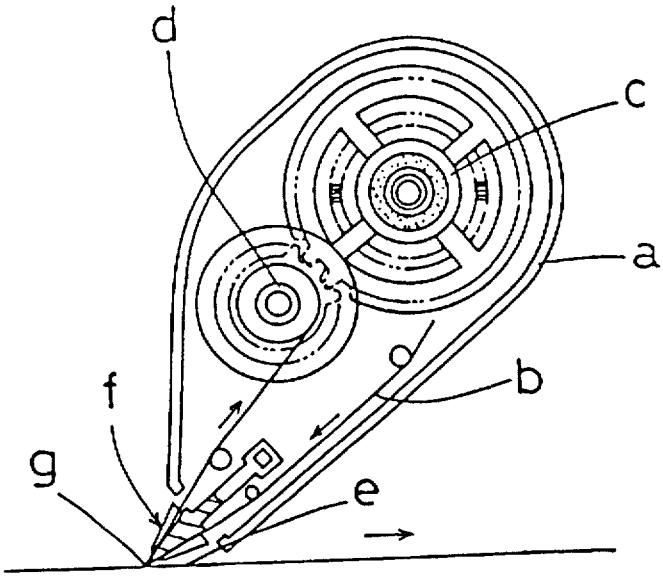
FIG. 16(a) PRIOR ART
FIGS. 16(*a*) and (*b*) are partially cut-away front views of the internal structure of conventional erasing tools.
Figure 16B:
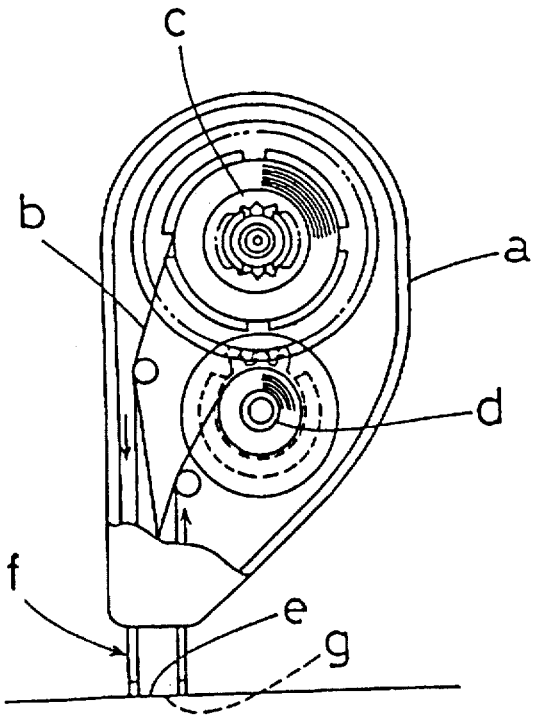
FIG. 16(b) PRIOR ART

In this case, for easy and secure transfer of the adhesive layer, as shown in FIG. 15, a transfer roller 70 is rotatably attached as a leading end pressing part to the leading end of the head main body 30 of the head H by means of a support pin 71, and it is more preferably when it is constituted so that the transfer roller 70 presses the coating film transfer tape T while rotating.

(2) A detailed structure of the support base 10 is not limited to that of the embodiment shown, as far as it is composed of a thin plate having a strength sufficient for holding the reels 11, 12 and corresponding to the rotation parts 40, 41 in the tape driving part D and the head H corresponding to the cylindrical leading end 6 of the case main body 3.

(3) Although the free end of drum part 11*a* in the pay-out reel 11 is an open end in the embodiment shown, considering a manufacturing process and cost of the tape cartridge C, it may be arranged such that a guide flange 100 for tape running similar to that of the take-up winding reel 12 may be removably attached to the free end of drum part 11*a*, as shown by a double dot chain line in FIG. 4.

With such an arrangement, the guide flange 100 can be removed when winding the coating film transfer tape T. Then, by attaching the guide flange 100 after winding of the tape is completed, the coating film transfer tape T can be more smoothly paid out, or when conveying or replacing the tape cartridge C, the trouble of the coating film transfer tape T dislocating out of the drum 11*a* can be securely prevented.

Basic structure of the coating film transfer tool 1:

(4) A detailed structure of the interlocking part 32 is not limited to that of the embodiment described above, and may be properly formed. For example, in the illustrated embodiment, the frictional force by thrust load is utilized, but it may be also possible to make use of the frictional force by a radial load.

(5) In the illustrated embodiment, the head H can be rotated to both a vertical pulling operation position X and a lateral pulling operation position Y, so that vertical pulling use and lateral pulling use can be freely selected, but the invention may be also applied to the coating film transfer tool with the structure fixed to either method of use. For example, in the structure for lateral pulling use only, the vertical pulling operation position X in the illustrated embodiment is omitted, so that the first and second engagement parts 65*a*, 65*b* may be omitted.

As described herein, in the tape cartridge of the invention, on a support base of a thin flat plate, a rotatable pay-out reel for winding a coating film transfer tape, a rotatable winding reel for collecting the coating film transfer tape after use, and a coating film transfer head for pressing the coating film transfer tape on a transfer area are provided, and through the leading end pressing part of the head, the coating film transfer tape paid out from the pay-out reel is wound on the winding reel, both reels are detachably and rotatably engaged with a pay-out rotation part and a winding rotation part rotatably disposed in the case, respectively, and the head is projected and held in the head holding part provided at the leading end of the case, so that the used and new cartridges can be replaced instantly, easily, promptly, and securely, together with the support base.

More specifically, by engaging both reels with the pay-out rotation part and winding rotation part of the case main body of the coating film transfer tool, and setting the head in the head holding part provided at the leading end of the case main body, while mounting the support base on these rotation parts, the replacement job is complete. Therefore, for a general user, if not experienced in the job, easy and secure replacement is guaranteed.

Moreover, the support base is a thin flat plate, and both reels and coating film transfer head are held only by this support base. Hence the number of parts is reduced, the structure is small and simplified, and the product cost can be lowered. Accordingly, while making the best of the structural benefits of the refill type, that is, saving of resources and reduction of running cost, the coating film transfer tool itself can be reduced in size, and its portability and hand-held operation are assure.

Besides, in the coating film transfer tool of the invention, the head can be rotated between the coating film transfer tape replacement position and application position, and when the leading end pressing part of the head is at the coating film transfer tape replacement position, the coating film transfer tape is guided as being wound on the pay-out reel and winding reel, and when the leading end pressing part of the head is at the application position, the coating film transfer tape is guided as being nearly opposite to the gripping surfaces of the case, thereby the structure is realized to satisfy the two hitherto impossible requests of lateral pulling use and replacement of coating film transfer tape.

The practical embodiment shown in the detailed description of the invention is taken only for clarifying technical details of the invention only, and the invention, therefore, is not limited to the embodiment described above, and should not be understood in a narrow sense, but should be understood in a broad sense that various modifications may be made in the invention within the spirits thereof and the scope defined by the claims.

What is claimed is:

1. A tape cartridge for insertion into a coating film transfer tool which transfers a coating film on a coating film transfer tape to a sheet surface, said tape cartridge comprising:

the coating film transfer tape;

a thin and flat support means having a shape and dimensions sufficient to be accommodated in a case of the coating film transfer tool;

tape feeding means, provided on the support means, for paying out and for feeding the coating film transfer tape;

coating film transfer means provided on the support means, said coating film transfer means for pressing the coating film transfer tape supplied from the tape feeding means onto the sheet surface; and tape collecting means, provided on the support means, for collecting the coating film transfer tape after use by way of the coating film transfer means, wherein the tape feeding means and tape collecting means are constructed for detachable and interlocking engagement with a pay-out driving means and a winding driving means which are rotationally mounted in the case of the coating film transfer tool, respectively; and wherein the coating film transfer means is held in a transfer means holding part of the coating film transfer tool, the transfer means holding part provided at a leading end of the case of the coating film transfer tool wherein the coating film transfer means is detachable from the case and projects from the case, and wherein the support means for holding and positioning the tape feeding means, coating film transfer means and tape collecting means at least until said tape feeding means, coating film transfer means and tape collecting means are respectively attached to the pay-out driving means, transfer means holding part and winding driving means of the coating film transfer tool.

2. A tape cartridge according to claim 1, wherein said coating film transfer means is rotatable between first and second positions.

3. A tape cartridge according to claim 1, wherein said support means being a positioning and holding means for positioning and holding said tape feeding means and tape collecting means only until they are in engagement with the driving means.

4. A tape cartridge for insertion into a coating film transfer tool which transfers a coating film on a coating film transfer tape to a sheet surface said tape cartridge comprising:

the coating film transfer tape;

a thin and flat support base having a shape and dimensions for accommodation in a case of the coating film transfer tool;

a pay-out reel rotatably provided on the support base, and having the coating film transfer tape wound thereabout;

a coating film transfer head provided on the support base, said coating film transfer head for pressing the coating film transfer tape paid out from the pay-out reel onto the sheet surface; and a winding reel, rotatably provided on the support base, for collecting the coating film transfer tape after use by way of the coating film transfer head, wherein the pay-out reel and winding reel are constructed such that they are detachably engaged and integrally rotatable with a pay-out rotation part and a winding rotation part which are rotatable mounted in the case of the coating film transfer tool; and wherein the coating film transfer head is held in a head holding part of the case of the coating film transfer tool, wherein the coating film transfer head is detachable from the case and projects from the case; and wherein the support base holds and positions the pay-out and winding reels and coating film transfer head at least until respectively mounted on the pay-out and winding rotation parts and head holding part of the coating film transfer tool.

5. A tape cartridge for transferring a coating film according to claim 4, wherein the support base comprises a plate having a strength sufficient for positioning and holding the pay-out reel and winding reel at a spacing corresponding to a spacing between the pay-out and winding rotation parts of the coating film transfer tool, and for positioning and holding the coating film transfer head at a position corresponding to the head holding part of the coating film transfer tool and wherein a guide surface, for running the coating film transfer tape, is provided on one side surface of said plate.

6. A tape cartridge for transferring a coating film according to claim 4, further comprising a tape protective wall disposed integral with and supported by the support base to cover an outer circumference of said pay-out reel.

7. A tape cartridge for transferring a coating film according to claim 4, wherein both reels have drum parts, the drum parts have support ends rotatably supported on the support base, and at least one tape guide flange is provided on a free end of the winding reel.

8. A tape cartridge for transferring a coating film according to claim 7, wherein a tape guide flange is detachably provided at a free end of the drum part of the pay-out reel.

9. A tape cartridge for transferring a coating film according to claim 4, wherein the support base is provided with a first guide pin for guiding the coating film transfer tape paid out from the pay-out reel, and a second guide pin for guiding the coating film transfer tape taken up on the winding reel.

10. A tape cartridge for transferring a coating film according to claim 9, further comprising a guide roller for rotating and guiding the coating film transfer tape, said guide roller is rotatably supported at least on the second guide pin.

11. A tape cartridge for transferring a coating film according to claim 4, wherein the coating film transfer head is provided integrally on the support base, rotatably between a coating film transfer tape replacement position as the first position and an application position as the second position, and when said head is in a coating film transfer tape replacement position, a leading end pressing part of the coating film transfer head is designed to guide the coating film transfer tape as it is unwound from the pay-out reel and taken up by winding reel.

12. A tape cartridge for transferring a coating film according to claim 11, wherein the coating film transfer head consists of a head main body having the leading end pressing part, and a bearing rotatably supported on a head mounting part of the support base, wherein the bearing is semicylindrical having a tape setting opening to the head main body, and wherein the tape setting opening is located so as to pass the coating film transfer tape from a state of being wound on the pay-out reel to a state of being wound on the winding reel when the coating film transfer head is in the coating film transfer tape replacement position.

13. A tape cartridge for transferring a coating film according to claim 12, further comprising a transfer roller formed as the leading end pressing part the transfer roller is rotatably attached to the leading end of the head main body.

14. A tape cartridge for transferring a coating film according to claim 12, wherein the head mounting part of the support base has a tape guide part having a cylindrical guide surface corresponding to an inside cylindrical surface of the bearing of the coating film transfer head.

15. A tape cartridge for transferring a coating film according to claim 4, further comprises a detachable stopper for stopping and holding the rotation of both reels.

16. A tape cartridge for transferring a coating film according to claim 4, wherein the coating film transfer tape comprises in sequence, a releasing agent layer on one side of a film base substrate, a white corrective paint layer disposed thereon, and a pressure sensitive adhesive agent layer disposed on said white corrective paint layer.

17. A tape cartridge for transferring a coating film according to claim 4, wherein the coating film transfer tape has an adhesive layer disposed on one side of a film base and a releasing agent layer interposed therebetween.

18. A tape cartridge according to claim 4, wherein said coating film transfer head is rotatable between first and second positions.

19. A tape cartridge according to claim 4, wherein said support base positions and holds said reels only until they are engaged with said rotation parts.

20. A coating film transfer tool comprising:

a case having a shape and dimensions for allowing operation by holding it with one hand, and having a pair of confronting gripping surfaces for allowing it to be held by hand like a writing tool;

a pay-out rotation part rotatably provided in the case;

a winding rotation part rotatably provided in the case;

a tape cartridge detachably installed on both rotation parts; and a head holding part provided at a leading end of the case for positioning and holding a coating film transfer head, wherein the tape cartridge comprises:

a coating film transfer tape;

a thin and flat support base in a form of a flat plate having a shape and dimensions for accommodation in the case, a pay-out reel rotatably provided on the support base and winding the coating film transfer tape thereabout, the coating film transfer head provided on the support base, the coating film transfer head for pressing the coating film transfer tape paid out from the pay-out reel onto a transfer area, and a winding reel rotatably provided on the support base for taking up and collecting the coating film transfer tape after use by way of the coating film transfer head, the pay-out reel and winding reel are structured to be detachably and integrally rotatably engaged with the pay-out rotation part and winding rotation part, respectively, and the coating film transfer head is held in the head holding part, wherein the coating film transfer head is detachable from the case and projects from the case, and wherein said support base holding and positioning the reels and head at least until respectively mounted on the rotation parts and head holding part.

21. A coating film transfer tool according to claim 20, wherein the head holding part has an operation member for rotating and operating the coating film transfer head between a coating film transfer tape replacement position and an application position.

22. A coating film transfer tool according to claim 21, wherein the operation member is engaged with the head holding part when the coating film transfer head is at the coating film transfer tape replacement position, and by rotating and operating the operation member together with the coating film transfer head from the coating film transfer tape replacement position to the application position, the case is assembled and fixed.

23. A coating film transfer tool according to claim 20, wherein a leading end pressing part of the coating film transfer head guides the coating film transfer tape such that a flat surface of said tape is substantially parallel to the gripping surfaces of the case in an application position.

24. A coating film transfer tool according to claim 20, wherein said coating film transfer head is rotatable between first and second positions.

25. A coating film transfer tool according to claim 20, wherein said support base positions and holds said reels only until they are engaged with said rotation parts.

* * * * *